US012747532B2

(12) United States Patent
Choe et al.

(10) Patent No.: US 12,747,532 B2
(45) Date of Patent: Sep. 29, 2026

(54) CLOTHES TREATMENT APPARATUS, AND CONTROL METHOD FOR CLOTHES TREATMENT APPARATUS

(71) Applicant: LG Electronics Inc., Seoul (KR)

(72) Inventors: Woonje Choe, Seoul (KR); Chungill Lee, Seoul (KR); Nagyoung Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 437 days.

(21) Appl. No.: 18/573,150

(22) PCT Filed: Jun. 21, 2022

(86) PCT No.: PCT/KR2022/008746
§ 371 (c)(1),
(2) Date: Dec. 21, 2023

(87) PCT Pub. No.: WO2022/270858
PCT Pub. Date: Dec. 29, 2022

(65) Prior Publication Data

US 2024/0295067 A1 Sep. 5, 2024

(30) Foreign Application Priority Data

Jun. 21, 2021 (KR) ..... 10-2021-0080204
Jun. 21, 2021 (KR) ..... 10-2021-0080205

(51) Int. Cl.
*D06F 58/38* (2020.01)
*D06F 103/04* (2020.01)
*D06F 103/08* (2020.01)

(52) U.S. Cl.
CPC ..... *D06F 58/38* (2020.02); *D06F 2103/04* (2020.02); *D06F 2103/08* (2020.02)

(58) Field of Classification Search
CPC .. D06F 58/38; D06F 2103/04; D06F 2103/08; D06F 58/08; D06F 2105/46; D06F 2105/48
See application file for complete search history.

(56) References Cited

U.S. PATENT DOCUMENTS

2014/0259449 A1* 9/2014 Alexander ..... C11D 1/835 8/137
2019/0169784 A1 6/2019 Seo et al.
2020/0190727 A1 6/2020 Kim et al.

FOREIGN PATENT DOCUMENTS

CH 659841 A5 2/1987
CN 103243515 A 8/2013
(Continued)

OTHER PUBLICATIONS

Extended European Search Report in European Appln. No. 22828705.8, mailed on May 12, 2025, 9 pages.
(Continued)

*Primary Examiner* — Jessica Yuen
(74) *Attorney, Agent, or Firm* — Fish & Richardson P.C.

(57) ABSTRACT

The present application relates to a control method for a clothes treatment apparatus, comprising: a laundry amount sensing step of determining the amount of clothes stored in a drum; a setting step of setting, as a reference rotation number, the number of rotations that causes a centrifugal force of less than 1 G to the clothes according to the amount of clothes; an air supply step of supplying, by a drying unit, heated air to the drum; and a first motion execution step of rotating the drum at the reference rotation number, a first rotation number set to be higher than the reference rotation number, and a second rotation number set to be lower than the reference rotation number.

14 Claims, 14 Drawing Sheets

(56) References Cited

FOREIGN PATENT DOCUMENTS

| | | | | |
|---|---|---|---|---|
| CN | 107747204 | A | 3/2018 | |
| EP | 2607537 | A1 * | 6/2013 | ..... D06F 33/48 |
| JP | 2001-070698 | | 3/2001 | |
| JP | 2016-052395 | | 4/2016 | |
| JP | 2018-138096 | | 9/2018 | |
| KR | 10-1999-0047134 | A | 7/1999 | |
| KR | 10-2006-0121401 | A | 11/2006 | |
| KR | 10-2008-0085394 | A | 9/2008 | |
| KR | 10-2012-0014429 | | 2/2012 | |
| KR | 10-2012-0106244 | A | 9/2012 | |
| KR | 10-2018-0023277 | | 3/2018 | |
| KR | 10-2020-0065931 | A | 6/2020 | |
| KR | 10-2020-0073063 | | 6/2020 | |
| KR | 10-2020-0075538 | A | 6/2020 | |

OTHER PUBLICATIONS

Office Action in Chinese Appln. No. 202280043615.5, mailed on Nov. 27, 2025, 11 pages (with English translation).
International Search Report and Written Opinion in Appln. No. PCT/KR2022/008746, mailed on Oct. 11, 2022, 18 pages (with English translation).
Notice of Allowance in Korean Appln. No. 10-2021-0080204, mailed on Nov. 19, 2024, 2 pages (with English translation).

* cited by examiner

CLOTHES TREATMENT APPARATUS, AND CONTROL METHOD FOR CLOTHES TREATMENT APPARATUS

CROSS-REFERENCE TO RELATED APPLICATIONS

This application is a National Stage application under 35 U.S.C. § 371 of International Application No. PCT/KR2022/008746, filed on Jun. 21, 2022, which claims the benefit of Korean Application Nos. 10-2021-0080205, filed on Jun. 21, 2021, and 10-2021-0080204, filed on Jun. 21, 2021. The disclosures of the prior applications are incorporated by reference in their entirety.

TECHNICAL FIELD

The present disclosure relates to a laundry treatment apparatus and a control method thereof.

BACKGROUND ART

A laundry treatment apparatus is a general term for a washing machine that washes clothes (objects to be washed or objects to be dried), a dryer that dries clothes, and an apparatus that both washes and dries clothes.

The washing machine generally includes a tub in which water is stored, a washing drum provided inside the tub to store clothes therein, and a driving part (washing driving part) that rotates the washing drum. The dryer generally includes a drying drum in which clothes are stored, a driving part (drying driving part) that rotates the drying drum, and a heat exchange part that supplies air to the drying drum to remove moisture from the clothes.

The washing driving part generally include a stator fixed to the tub to form a rotating magnetic field, a rotor rotated by the rotating magnetic field, and a rotation shaft passing through the tub to connect the washing drum and the rotor, whereas the drying driving part generally includes a motor, a pulley fixed to a rotation shaft of the motor, and a belt (power transmission part) transmitting the rotation motion of the pulley to the drying drum.

The washing driving part is configured such that the rotation shaft of the motor connects the washing drum and the rotor. In order to wash or spin-dry clothes, the washing driving part needs to increase the rotation speed of the washing drum to a high level or change the rotation direction of the washing drum. When the rotation shaft of the motor directly connects the washing drum to the rotor, the rotation speed and the rotation direction of the washing drum may be easily controlled.

Meanwhile, a conventional drying driving part generally has a structure in which a power transmission part such as a belt connects the drying drum to the rotation shaft of the motor. The is because, in the dryer, there is little need to keep the rotation speed of the drying drum high or change the rotation direction of the drying drum. Therefore, the dryer may rotate the drying drum through the power transmission part such as the belt. However, if the rotation speed and rotation direction of the drying drum are changeable, since the movement of clothes inside the drying drum will be controllable, it may be expected for the dryer to reduce a drying time and improve drying performance.

Among conventional dryers, there is a dryer including a drying driving part that connects the rotor to the drying drum by means of a reducer (Publication No. 10-2020-0065931). The drying driving part is configured such that an input shaft connected to the rotor and an output shaft connected to the drying drum are coaxially formed, so it is expected to shorten a drying time or improve drying performance. However, since heat supplied to the drying drum is transmitted to the inside of the drying driving part, there has been a possibility of the durability of the dry driving part deteriorating.

In addition, among conventional dryers, there is a dryer to which a control method is applied that expands an area in which clothes contact air by controlling the rotation speed of a drum while air is supplied to the drum (Registration No. 10-1594368). However, in the above-mentioned dryer, how to control the rotation direction and rotation speed of the drum in each section (a preheating section, a constant rate drying section, and a reduced rate drying section) that constitutes a drying process in order to improve drying performance (shortening of a drying time or minimization of under-drying or over-drying) has not been known.

DISCLOSURE

Technical Problem

An object of the present disclosure is to provide a laundry treatment apparatus including a power transmission part that connects an input shaft connected to a rotor and an output shaft connected to a drum to each other to form coaxiality between the input shaft and the output shaft and a control method of the laundry treatment apparatus.

Another object of the present disclosure is to provide a laundry treatment apparatus capable of minimizing deterioration in durability of a power transmission part by minimizing transfer of external heat to the inside of the power transmission part and a control method of the laundry treatment apparatus.

Another object of the present disclosure is to provide a laundry treatment apparatus capable of improving drying performance and a control method of the laundry treatment apparatus.

Another object of the present disclosure provides a laundry treatment apparatus capable of improving drying performance when drying bulky clothes such as blankets and a control method of the laundry treatment apparatus.

Technical Solution

According to an aspect of the present disclosure, provided herein is a control method of a laundry treatment apparatus including: a drum configured to form a space in which clothes are stored and having an entrance formed on a front surface thereof, a fixing panel; an output shaft configured to pass through the fixing panel so as to be connected to the drum; an input shaft configured to be rotated by a motor and form coaxiality with the output shaft; a gear unit configured to connect the input shaft to the output shaft to rotate the output shaft at a rotation speed lower than a rotation speed of the input shaft; and a drying part configured to supply heated air or unheated air to the drum. The control method includes: a laundry weight determination operation of determining the amount of clothes stored in the drum; a setting operation of setting a rotation speed that causes a centrifugal force of 1G or less according to the amount of clothes to a reference rotation speed; an air supply operation of supplying heated air to the drum by the drying part; and a first motion execution operation of rotating the drum at a reference rotation speed, a first rotation speed set to be higher than the reference rotation speed, and a second rotation speed set to be lower than the reference rotation speed.

The first motion execution operation may include: rotating the drum in a first direction set to any one of a clockwise direction and a counterclockwise direction at the reference rotation speed; rotating the drum in the first direction at the first rotation speed; and rotating the drum in the first direction at the second rotation speed.

The first motion execution operation may sequentially perform rotating the drum in the first direction at the reference rotation speed, rotating the drum in the first direction at the first rotation speed, and rotating the drum in the first direction at the second rotation speed.

The control method may further include a second motion execution operation performed after completion of the first motion execution operation. The second motion execution operation may include: rotating the drum in a second direction set to the other one of the clockwise direction and the counterclockwise direction at the reference rotation speed; rotating the drum in the second direction at the first rotation speed; and rotating the drum in the second direction at the second rotation speed.

The second motion execution operation may sequentially execute rotating the drum in the second direction at the reference rotation speed, rotating the drum in the second direction at the first rotation speed, and rotating the drum in the second direction at the second rotation speed.

The control method may further include a first constant speed operation of rotating the drum at the reference rotation speed, wherein the first constant speed operation is performed before the first motion execution operation is performed.

The first constant speed operation may be configured to rotate the drum in only one of the clockwise direction and the counterclockwise direction.

The first constant speed operation may be configured to alternately rotate the drum in the clockwise direction and the counterclockwise direction.

The first rotation speed may be set to a value greater than the reference rotation speed by a preset first reference value, and the second rotation speed may be set to a value smaller than the reference rotation speed by a second reference value.

The first reference value may be set to be equal to the second reference value.

The first reference value and the second reference value may be set to values less than 10% of the reference rotation speed.

When a dryness of the clothes stored in the drum reaches a preset target dryness, the first motion execution operation and the second motion execution operation may be terminated, and a second constant speed of rotating the drum at the reference rotation speed may be performed.

The control method may further include at least one of: a cooling operation of supplying unheated air to the drum; or a steam supply operation of supplying steam to the drum, during execution of the second constant speed motion.

The first constant speed motion may be performed until the dryness of the clothes reaches a first dryness set to be lower than the target dryness, and the first motion execution operation may be started when the dryness of the clothes reaches the first dryness.

The first dryness may be set to a dryness with a moisture content of 40% to 50%, and the target dryness may be set to a dryness with a moisture content of 3% to 5%.

In another aspect of the present disclosure, provided herein is a control method of a laundry treatment apparatus including: a drum configured to form a space in which clothes are stored and having entrance formed on a front surface thereof, a fixing panel; an output shaft configured to pass through the fixing panel so as to be connected to the drum; an input shaft configured to be rotated by a motor and form coaxiality with the output shaft; a gear unit configured to connect the input shaft to the output shaft to rotate the output shaft at a rotation speed lower than a rotation speed of the input shaft; and a drying part configured to supply heated air or unheated air to the drum. The control method includes an air supply operation of supplying heated air to the drum; and a first motion execution operation of rotating the drum.

The first motion execution operation may include rotating the drum in a first direction set to any one of a clockwise direction and a counterclockwise direction at a first rotation speed causing a centrifugal force of 1G or more on the clothes; rotating the drum in the first direction at a second rotation speed greater than the first rotation speed; rotating the drum in a second direction set to the other one of the clockwise direction and the counterclockwise at the first rotation speed; and rotating the drum in the second direction at the second rotation speed.

The first motion execution operation may be configured to sequentially perform rotating the drum in the first direction at the first rotation speed, rotating the drum in the first direction at the second rotation speed, rotating the drum in the second direction at the first rotation speed, and rotating the drum in the second direction at the second rotation speed.

The control method may further include a second motion execution operation performed after completion of the first motion execution operation. The second motion execution operation may include rotating the drum in the first direction at the first rotation speed; rotating the drum in the first direction at the second rotation speed; rotating the drum in the first direction at a third rotation speed lower than the first rotation speed; rotating the drum in the second direction at the first rotation speed, rotating the drum in the second direction at the second rotation speed; and rotating the drum in the second direction at the third rotation speed.

The second motion execution operation may be configured to sequentially perform rotating the drum in the first direction at the first rotation speed, rotating the drum in the first direction at the second rotation speed; rotating the drum in the first direction at the third rotation speed; rotating the drum in the second direction at the first rotation speed, rotating the drum in the second direction at the second rotation speed; and rotating the drum in the second direction at the third rotation speed.

The second rotation speed may be set to a rotation speed obtained by adding a first reference value to the first rotation speed, and the third rotation speed may be set to a rotation speed obtained by subtracting a second reference value from the first rotation speed.

The first reference value and the second reference value may be set to values less than 10% of the first reference value.

The first reference value may be set to be equal to the second reference value.

The first motion execution operation may be performed until a dryness of the clothes stored in the drum reaches a first dryness, and the second motion execution operation may be performed until the dryness of the clothes stored in the drum reaches a second dryness higher than the first dryness after the first motion execution operation is ended.

The second dryness may be set to a dryness at which a moisture content of the clothes is 5% to 3%, and the first dryness may be set to a dryness at which a moisture content of the clothes is 40% to 50%.

The first motion execution operation may be performed until an execution time of the air supply operation reaches a preset reference time.

The reference time may be set to a time at which a moisture content of the clothes is 40% to 50%.

The second motion execution operation may be performed until a dryness of the clothes stored in the drum reaches a preset target dryness after the first motion execution operation is ended.

The target dryness may be set to a dryness at which a moisture content of the clothes is 3% to 5%.

The control method may further include a constant speed motion execution operation of rotating the drum at a fourth rotation speed set to be lower than the third rotation speed after the second motion execution operation is ended; and a cooling operation of supplying unheated air to the drum.

The constant speed motion execution operation may be configured to rotate the drum in only one of the first direction and the second direction.

Advantageous Effects

The present disclosure provides a laundry treatment apparatus provided with a power transmission part that connects an input shaft connected to a rotor and an output shaft connected to a drum and causes the input shaft and the output shaft to form a coaxial axis and a control method of the laundry treatment apparatus.

In addition, the present disclosure provides a laundry treatment apparatus capable of minimizing deterioration in durability of a power transmission part by minimizing transfer of external heat into the power transmission part and a control method of the laundry treatment apparatus.

In addition, the present disclosure provides a laundry treatment apparatus capable of improving drying performance and a control method of the laundry treatment apparatus.

In addition, the present disclosure provides a laundry treatment apparatus capable of improving drying performance when drying bulky clothes such as blankets and a control method of the laundry treatment apparatus.

BEST MODE

Hereinafter, an embodiment of a laundry treatment apparatus will be described in detail with reference to the attached drawings.

Figure 1:
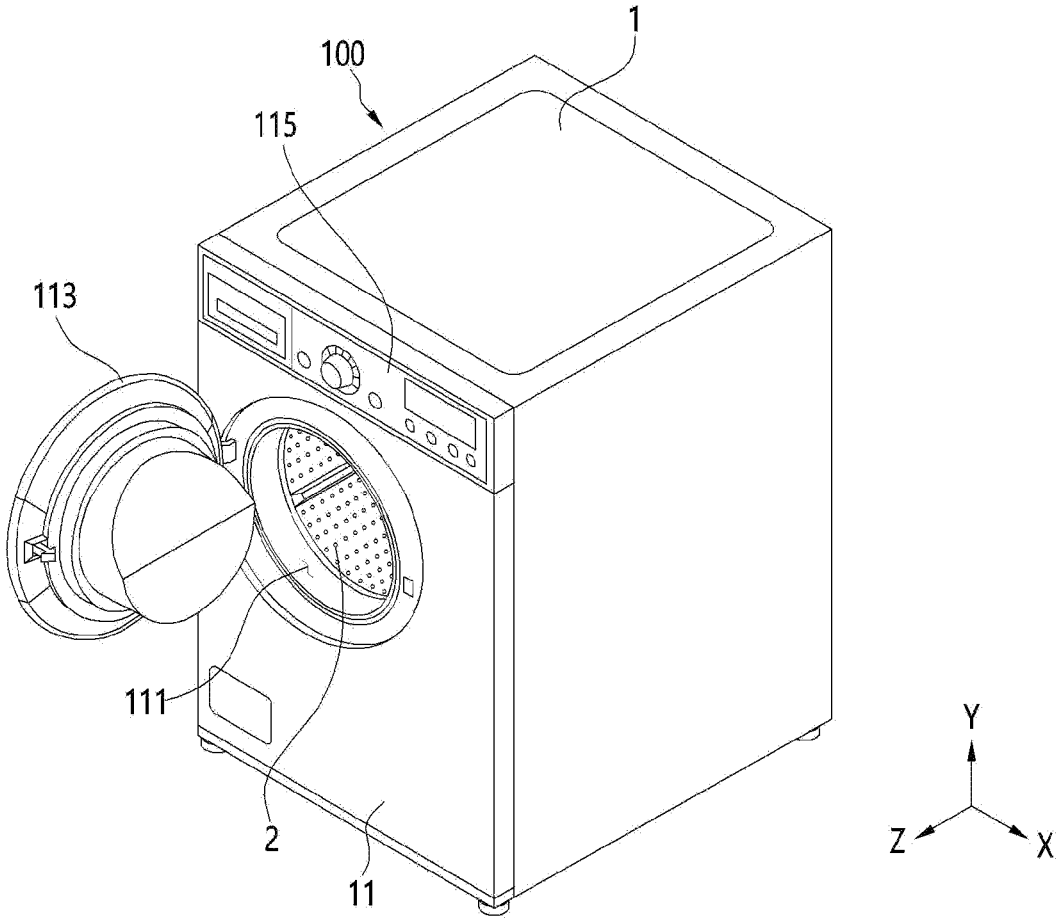
FIGS. 1 and 2 illustrate an example of a laundry treatment apparatus.
Figure 2:
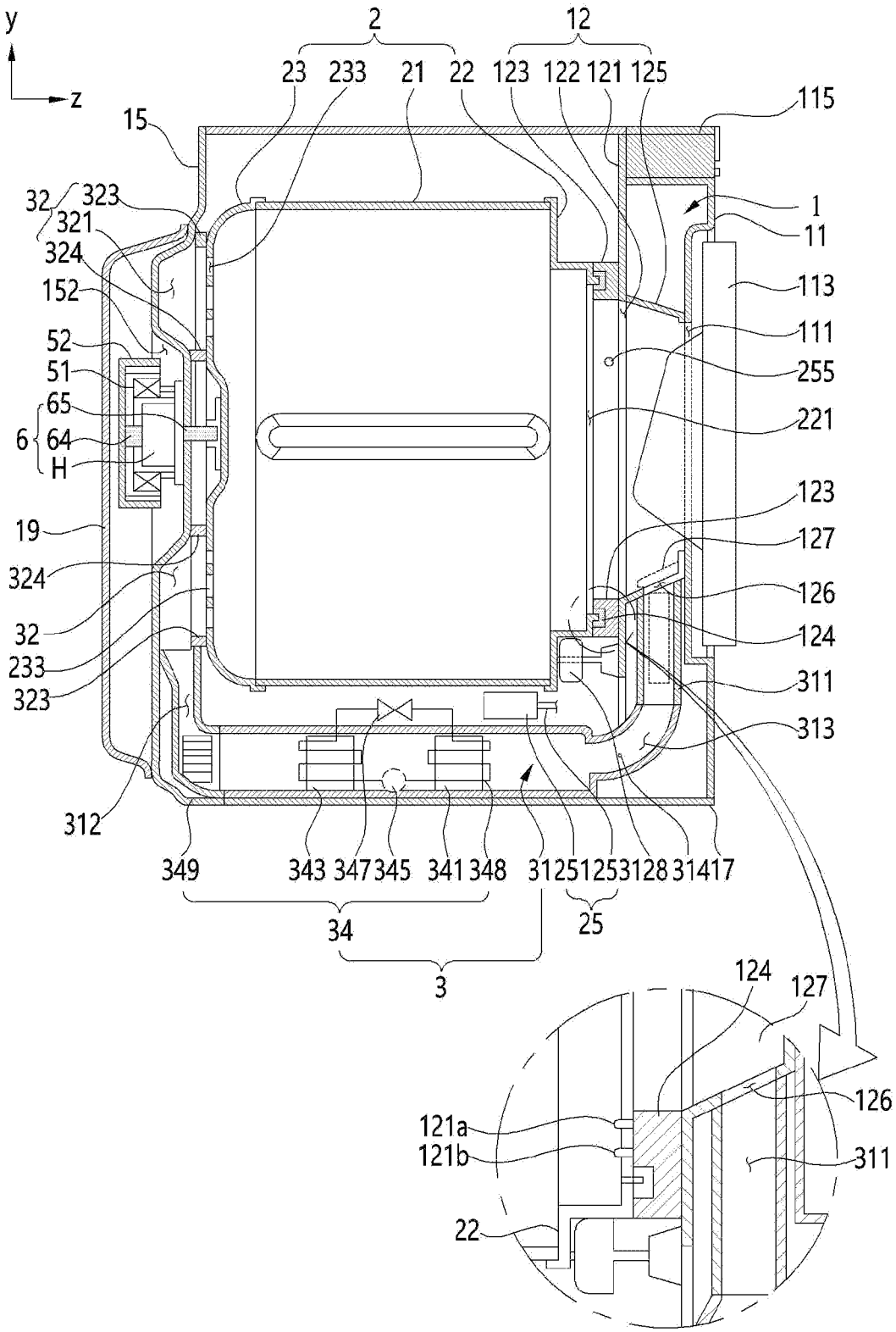

FIG. 1 illustrates an example of a laundry treatment apparatus 100. The laundry treatment apparatus 100 may include a cabinet 1 and a drum 2 which is rotatably provided inside the cabinet to provide a space for storing clothes (objects to be washed or objects to be dried). As illustrated in FIG. 2, the cabinet 1 may be provided therein with a drying part 3 configured to remove moisture from clothes by supplying hot and dried air (air having a temperature higher than an ambient temperature or air having a dryness higher than that of indoor air) to the drum 2.

Figure 3:
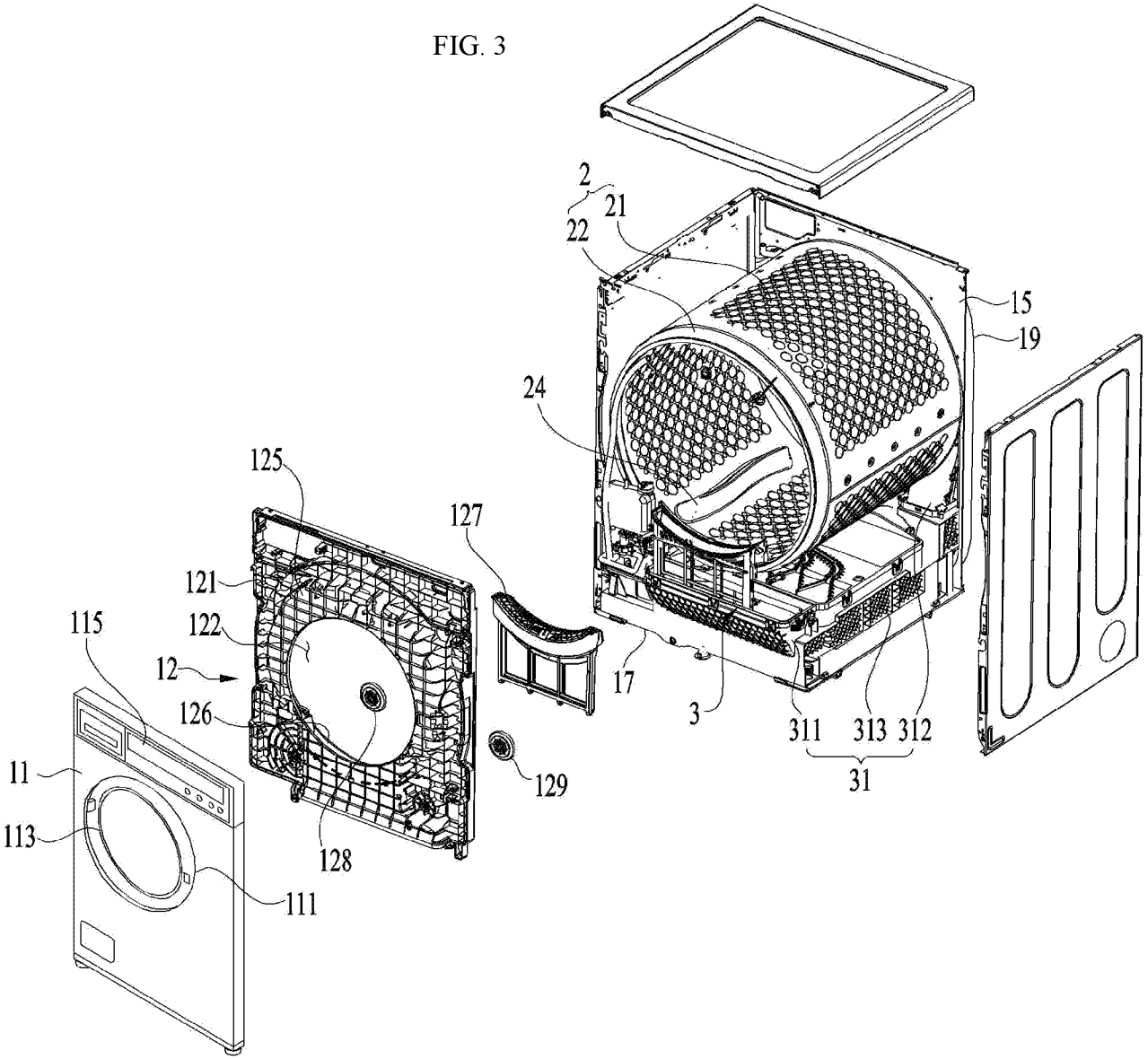
FIGS. 3 and 4 illustrate an example of an internal structure of the laundry treatment apparatus.

As illustrated in FIG. 3, the cabinet 1 includes a front panel 11 that forms a front surface of the laundry treatment apparatus and a base panel 17 that forms a bottom surface of the laundry treatment apparatus. The front panel 11 includes an entrance 111 communicating with the drum 2. The entrance 111 may be configured to be closed by a door 113.

A control panel 115 is disposed at the front panel 11. The control panel 115 may include an input part that receives control instructions from a user and a display part that outputs information such as control instructions selectable by the user. The input part may include a power supply request part that requests power supply to the laundry treatment apparatus, a course input part that allows the user to select a desired course from among a plurality of courses, and an execution request part that requests the start of the course selected by the user.

The drum 2 may be formed in a hollow cylindrical shape. FIG. 2 exemplarily illustrates that the drum 2 is configured by a cylindrical drum body 21, front and rear surfaces of which are open, a front cover 22 forming the front surface of the drum body 21, and a rear cover 23 forming the rear surface of the drum body 21. The front cover 22 may be provided with a drum entrance 221 that allows the inside of the drum body 21 to communicate with the outside, and the rear cover 23 may be provided with an air inflow port 233 through which external air is introduced into the drum body 21.

As illustrated in FIG. 3, the drum body 21 may further include a lifter 24. The lifter 24 may be configured such that a board extending from the front cover 22 toward the rear cover 23 protrudes from the drum body 21 toward the rotation center of the drum 2 (from the circumferential surface of the drum toward the rotation center of the drum).

When the laundry treatment apparatus 100 is designed to perform only drying of clothes, the drum 2 may not have drum through holes, which are configured to pass through the drum body 21 so as to allow the inside of the drum to communicate with the outside of the drum.

The drum 2 may be rotatably fixed to at least one of a first body support part 12 and a second body support 15. In the drawing, the rear cover 23 is rotatably fixed to the second body support part 15 through a motor 5 (driving part), and the front cover 22 is rotatably connected to the first body support 12.

The first body support part 12 may include a support panel 121 fixed to the cabinet 1 and disposed between the front plate 11 and the front cover 22. The support panel 121 may be fixed to the base panel 17 and be disposed between the front panel 11 and the front cover 22. In this case, the rear surface of the front panel 11 (the surface facing the support panel) is fixed to the support panel 121, and a lower end of the front panel 11 may be fixed to the base panel 17.

The support panel 121 may include a support panel through hole 122, a drum connection body 123 (see FIG. 2) connecting the support panel through hole 122 to the drum entrance 221, and a panel connection body 125 connecting the support panel through hole 122 to the entrance 111. The support panel through hole 122 is a means configured to pass through the support panel 121 to allow the entrance 111 to communicate with the drum entrance 221.

As illustrated in FIG. 2, the drum connection body 123 may include a pipe fixed to the rear surface of the support panel 121 (the surface facing the drum entrance in a space provided by the support panel). One end of the drum connection body 123 may be disposed to surround the support panel through hole 122, and a free end of the drum connection body 123 may be disposed to support the front cover 22. That is, the free end of the drum connection body 123 may be inserted into the drum entrance 221 or may be in contact with a free end of the front cover 22 forming the drum entrance 221.

FIG. 2 exemplarily illustrates the free end of the drum connection body 123 being in contact with the free end of the front cover 22. In this case, the drum connection body 123 may include a ring-shaped connection damper 124. The connection damper 124 may serve to reduce the risk of the drum entrance 221 being separated from the drum connection body 123 (the risk of air inside the drum leaking into the cabinet) when the drum 2 rotates or vibrates.

The panel connection body 125 may include a pipe fixed to the front surface of the support panel 121 (the surface facing the front panel in the space provided by the support panel). One end of the panel connection body 125 may be disposed to surround the support panel through hole 122, and the other end of the panel connection body 125 may be disposed to be connected to the entrance 111. Therefore, clothes supplied to the entrance 111 may be transferred to the drum body 21 through the panel connection body 125, the support panel thorough hole 122, the drum connection body 123, and the drum entrance 221.

The support panel 121 may include an exhaust port 126 configured to pass through the panel connection body 125. A filter 127 may be detachably fixed to the exhaust port 126. The filter 127 may have any structure capable of filtering contaminants from the air that flows to the exhaust port 126 from the drum 2.

The support panel 121 may further include drum support parts 128 and 129 configured to prevent the drum 2 from sagging. The drum support parts may include a first roller 128 and a second roller 129, which are fixed to the support panel 121 to rotatably support the drum 2. Although FIG. 3 illustrates that the first roller 128 and the second roller 129 support the drum body 21, the rollers 128 and 129 may be configured to support the front cover 22.

Figure 4:
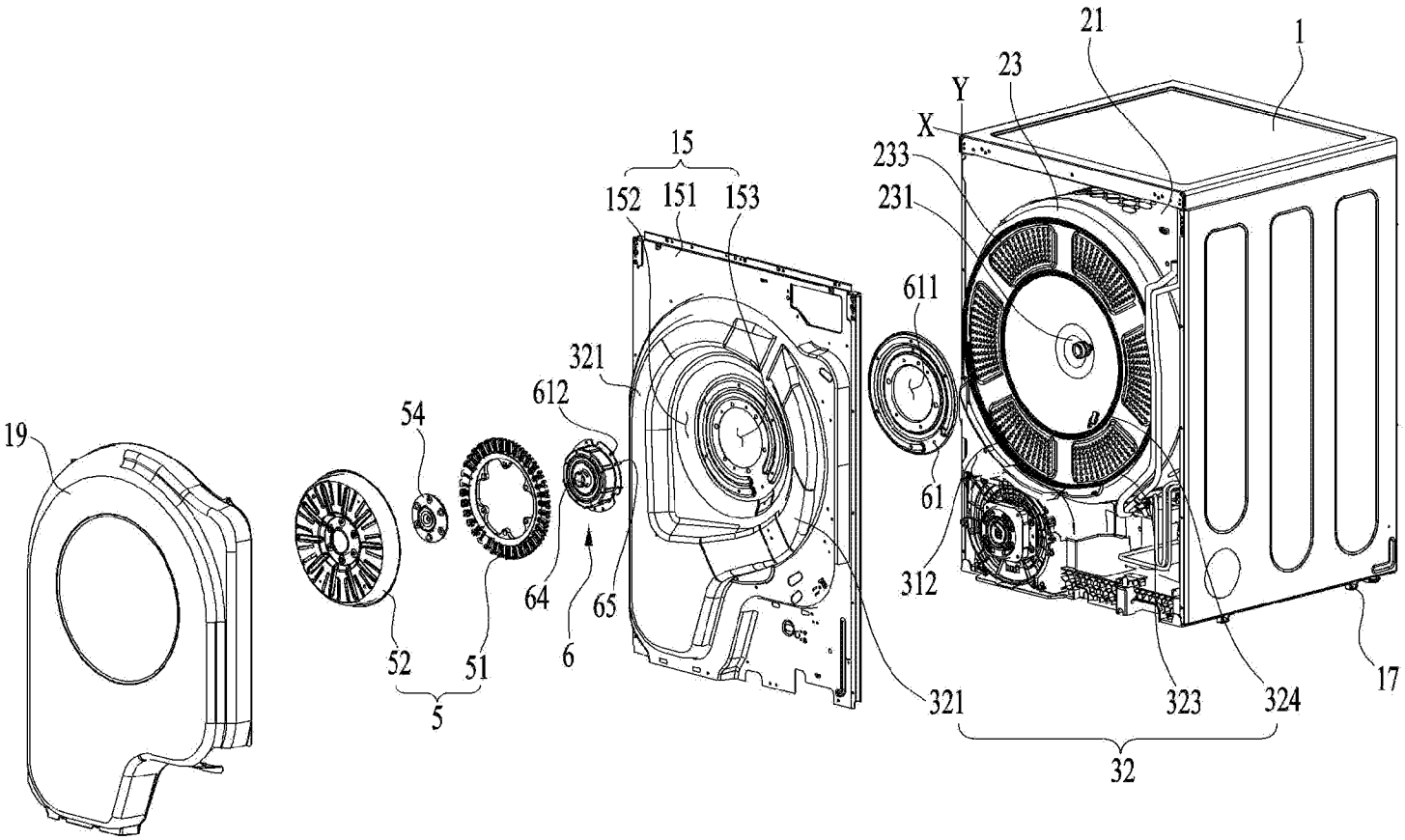

The second body support part 15 may include a fixing panel 151 fixed to the cabinet 1 at a position spaced apart from the rear cover 23. FIG. 4 exemplarily illustrates the fixing panel 151 fixed to the base panel 17 to form the rear surface of the laundry treatment apparatus 100 (the rear surface of the cabinet).

The fixing panel 151 may include a driving part mounting groove 152 that provides a space in which the motor 5 is mounted. The driving part mounting groove 152 may include a groove concavely bent from the fixing panel 151 toward the rear cover 23 of the drum. The fixing panel 151 includes a fixing panel through hole 153 through which a shaft (an output shaft) for rotating the drum 2 passes. The fixing panel through hole 153 may be located inside the driving part mounting groove 152.

As described above, when the drum 2 is provided with the drum body 21, the front cover 22 fixed to the drum body, and the rear cover 23 fixed to the drum body, the rigidity of the drum is increased, compared to a structure in which the front surface and the rear surface of the drum body 21, which are open, are rotatably connected to the support panel 121 and the fixing panel 151, respectively. The increased rigidity of the drum enables minimization of deformation of the drum body 21 during rotation of the drum, thereby minimizing a problem in which clothes are caught in a space between the drum body and the support panel and in a space between the drum body and the fixing panel (i.e., thereby enabling minimization of the load on the motor).

As illustrated in FIG. 2, the laundry treatment apparatus may include a steam supply part 25 configured to supply steam to the drum. The steam supply part 25 may include a steam generator 251 that generates steam and a steam passage 253 that guides steam inside the steam generator 251 to the drum. One end of the steam passage 253 may be connected to the steam generator 251, and the other end of the steam passage 253 may be connected to a steam supply port 255 configured to pass through the support panel 121.

The drying part 3 may include an exhaust passage 31 connected to the exhaust port 126, a supply passage 32 that guides the air in the exhaust passage 31 to the drum body 21, and a heat exchanging part 34 disposed inside the exhaust passage 31 to sequentially perform dehumidification and heating of the air.

The exhaust passage 31 may include a first duct 311 connected to the exhaust port 126, a second duct 312 connected to the supply passage 32, and a third duct 313 connecting the first duct to the second duct 312. The third duct 313 may be fixed to the base panel 17.

The heat exchanging part 34 may be implemented as various devices capable of sequentially performing dehumidification and heating of the air flowing into the exhaust passage 31. FIG. 2 exemplarily illustrates the heat exchanging part 34 implemented as a heat pump. That is, the heat exchanging part 34 includes a first heat exchanger (a heat adsorption part) 341 that removes moisture from the air flowing into the exhaust passage 31, a second heat exchanger (a heat radiation part) 343 disposed inside the exhaust passage 31 to heat the air that has passed through the heat adsorption part 341, and a fan 349 configured to cause the air discharged from the drum 2 to sequentially pass through the heat adsorption part and the heat radiation part and then to be transferred to the supply passage 32.

The heat adsorption part 341 and the heat radiation part 343 may be sequentially disposed in a direction in which the air flows and may be connected to each other via a refrigerant pipe 348 constituting a refrigerant circulation passage. Refrigerant may be transferred along the refrigerant pipe 348 by means of a compressor 345, which is positioned outside the exhaust passage 31, and the refrigerant pipe 348 is provided with a pressure regulator 347 that regulates the pressure of the refrigerant.

As illustrated in FIG. 4, the air inflow port 233 provided in the rear cover 23 of the drum includes a plurality of holes that are arranged to surround the center of the rear cover 23 (i.e., the rotation center of the drum). In this case, the supply passage 32 may include a supply duct 321 disposed at the fixing panel 151 to form a transfer path for the air discharged from the second duct 312, and a first passage forming part 323 and a second passage forming part 324 that guide the air inside the supply duct 321 to the air inflow port 233.

The supply duct 321 may be configured such that the fixing panel 151 is bent in a direction away from the rear cover 23 to form a passage (an air transfer passage). Furthermore, the supply duct 321 may be configured as a ring shape surrounding the driving part mounting groove 152, and the second duct 312 may be connected to the circumferential surface of the supply duct 321.

The first passage forming part 323 may be configured to surround the outer circumferential surface of a ring formed by the air inflow port 233, and the second passage forming part 324 may be configured to surround the inner circumferential surface of the ring formed by the air inflow port 233.

The first passage forming part 323 and the second passage forming part 324 may be fixed to the rear cover 23 and may also be fixed to the supply duct 321. FIG. 4 exemplarily illustrates the passage forming parts 323 and 324 fixed the rear cover 23. In FIG. 4, a free end of the first passage forming part 323 is configured to surround the outer circumferential surface of the passage (the ring-shaped passage) formed by the supply duct 321, and a free end of the second passage forming part 324 is configured to surround the inner circumferential surface of the passage formed by the supply duct 321. The first passage forming part 323 and the second passage forming part 324 may be made of rubber or felt.

The motor 5 configured to rotate the drum 2, includes a stator 51 positioned in the driving part mounting groove 152 to form a rotating field and a rotor 52 rotated by the rotating field. The rotational motion of the rotor 52 is transmitted to the drum 2 via a power transmission part 6 fixed to the fixing panel 151, and the stator 51 is fixed to at least one of the fixing panel 151 or the power transmission part 6. When the stator 51 is fixed to the power transmission part 6, there is an advantage in maintenance of coaxiality between an input shaft 65 and an output shaft 66 provided at the power transmission part 6 (it is possible to minimize vibration of the laundry treatment apparatus during rotation of the drum and deterioration of the durability of the power transmission part).

In order to prevent the motor 5 provided in the motor driving part mounting groove 512 from being exposed to the outside (to thus improve the durability of the motor and to prevent the occurrence of an accident), the fixing panel 151 may be further provided with a cover panel 19 for preventing the motor 5 from being exposed to the outside. In addition, the cover panel 19 may be configured as a shape capable of preventing the supply duct 321 from being exposed to the outside (a shape surrounding the supply duct 321). This serves not only to reduce leakage of heat to the outside of the supply duct 321 but also to prevent an accident that may occur when a human body comes into contact with the supply duct 321.

Figure 5:
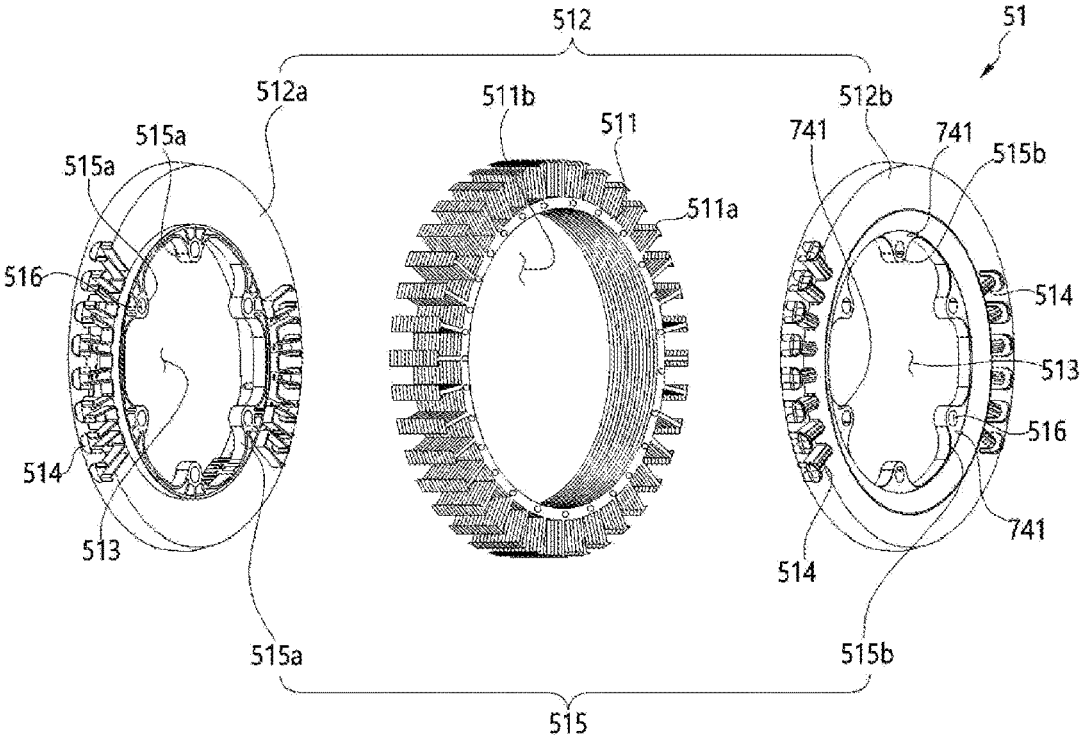
FIG. 5 illustrates an example of a stator.

As illustrated in FIG. 5, the stator 51 may include a core 511 (a ring-shaped core), which has a through hole (a core through hole 511*b*) formed at the center thereof, a plurality of support bars 511*a* protruding radially from the outer circumferential surface of the core 511, a core insulation part 512 of a ring shape configured to insulate the core, a plurality of support bar insulation parts 514 disposed at the core insulation part 512 to surround the support bars, and coils (not illustrated) disposed at the support bar insulation parts 514.

The core insulation part 512 is formed in the shape of a ring that has an insulation part through hole 513 formed at the center thereof in order to form a space in which the core 511 is accommodated. To facilitate assembly, the core insulation part 512 may include a first insulation body 512*a* and a second insulation body 512*b*. In this case, the support bar insulation parts 514 may include first support bar insulation parts provided in the first insulation body 512*a* and second support bar insulation parts provided in the second insulation body 512*b*.

The core insulation part 512 may include a stator bracket 515. The stator bracket 515 may include a plurality of brackets that protrude from the inner circumferential surface of the core insulation part 512 toward the center of the insulation part through hole 513. When the core insulation part 512 includes the first insulation body 512*a* and the second insulation body 512*b*, the stator bracket 515 may include first brackets 515*a* provided in the first insulation body and second brackets 515*b* provided in the second insulation body so as to be coupled to the first brackets 515*a*.

The stator bracket 515 may be fixed to the power transmission part 6 using a stator coupling part such as a bolt. To this end, the stator bracket 515 may include a coupling part through hole 516.

Figure 6:
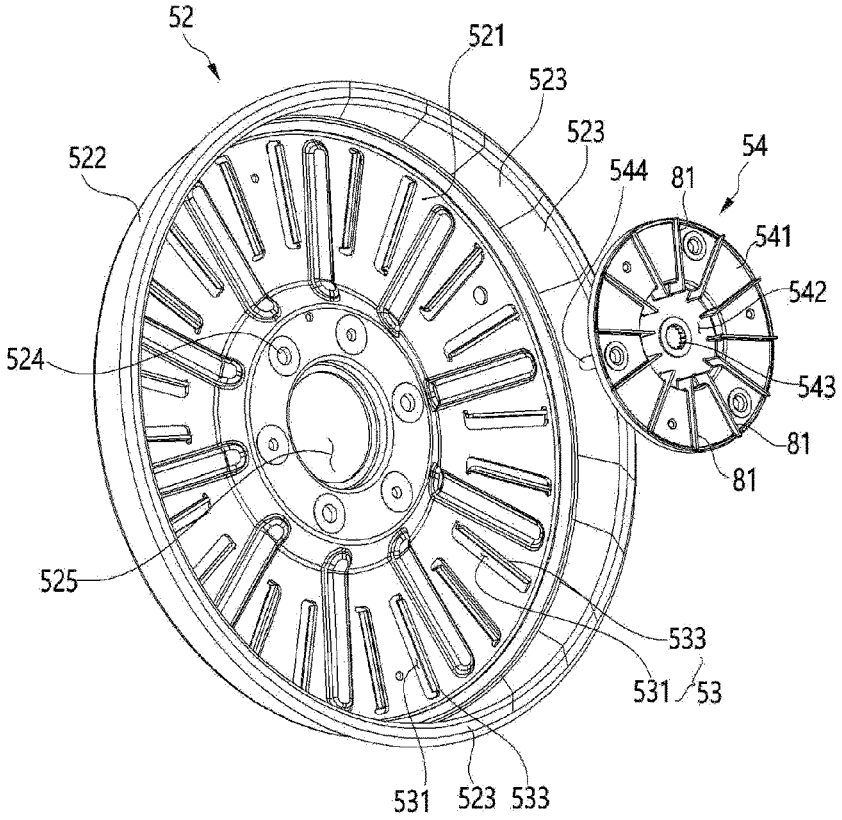
FIG. 6 illustrates an example of a rotor.

As illustrated in FIG. 6, the rotor 52 may include a rotor body 521, a rotor circumferential surface 522 extending from the edge of the rotor body 521 toward the fixing panel 515 to form a space in which the stator 51 is accommodated, and a plurality of permanent magnets 523 fixed to the rotor circumferential surface 522 such that N-poles and S-poles thereof are alternately exposed.

The motor 5 may further include a motor heat dissipation part 53 configured to dissipate heat generated from the stator 51 to the outside of the rotor 52. The motor heat dissipation part 53 may include a plurality of rotor through holes 531 configured to pass through the rotor body 521 and a plurality of rotor blades 533 provided at the rotor body 521 to form an airflow for causing the air inside the rotor to be transferred to the rotor through holes 531.

The rotor through-hole 531 may include a slit that extends from the center of the rotor body 521 toward the rotor circumferential surface 522, and the rotor blade 533 may include a plate that protrudes from the rotor body 521 toward the fixing panel 151. In this case, it is desirable for the rotor blade 533 to extend from the center of the rotor body 521 toward the rotor circumferential surface 522. The rotor through-hole 531 may include a plurality of slits radially disposed at the center of the rotor body 521 (e.g., the input shaft), and the rotor blade 533 may be fixed to the edge of the rotor through-hole 531.

Figure 7:
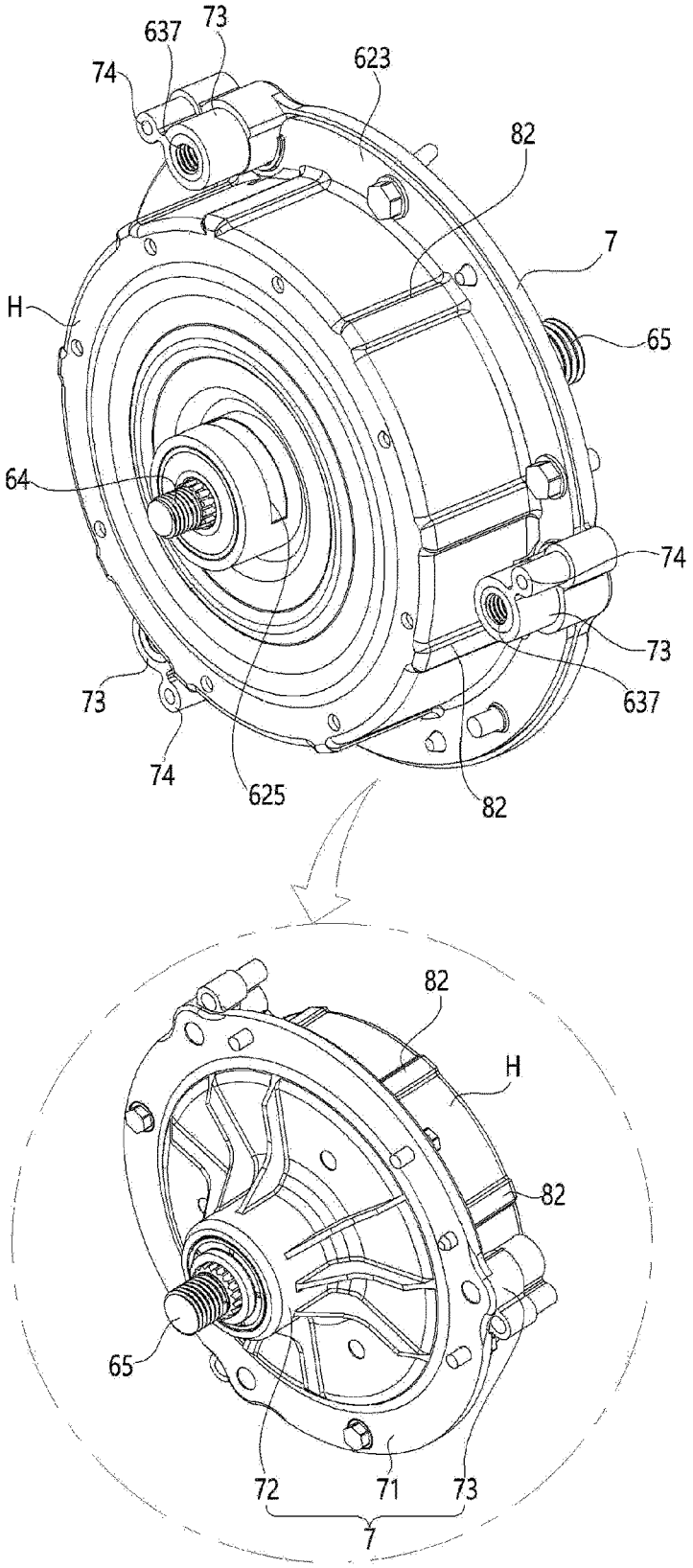
FIGS. 7 to 10 illustrate an example of a power transmission part.

FIG. 7 illustrates an example of the power transmission part 6. The power transmission part 6 may include a housing H fixed to the fixing panel 151, an input shaft 64 rotatably fixed to the bottom surface of the housing H (the surface facing a direction toward the rotor), an output shaft 65 rotatably fixed to the upper surface of the housing H (the surface facing a direction toward the fixing panel), and a gear unit provided inside the housing and to transmit the rotational motion of the input shaft 64 to the output shaft 65. The input shaft 64 may be implemented as a shaft that has one end fixed to the rotor 52 and the other end located inside the housing H. The output shaft 65 may be implemented as a shaft that has one end fixed to the rear cover 23 and the other end located inside the housing H.

It is desirable that the housing H be fixed to the fixing panel 151 and disposed in a space (an external space of the cabinet) separated from a space in which the drum 2 is located (an internal space in the cabinet). This serves to minimize transfer of heat in the cabinet (heat radiated from the drum or the drying part) to the inside of the housing H to thus improve the durability of the power transmission part 6.

The input shaft 64 may be coupled to the rotor body 521 using the shaft coupling part 54 illustrated in FIG. 6. The shaft coupling part 54 may include a disc-shaped coupling body 541 and a shaft coupling hole 543 configured to pass through the coupling body to allow one end of the input shaft 64 to be coupled thereto.

To facilitate assembly between the coupling body 541 and the rotor body 521, the coupling body 541 may include a body protrusion 544, and the rotor body 521 may include a body protrusion through hole 524 into which the body protrusion 544 is inserted.

Furthermore, in order to increase the strength of the coupling body 541, the coupling body 541 may further include a coupling body bent part 542. The coupling body bent part 542 may be formed such that the surface of the coupling body 541 facing the housing H is concavely bent toward the rotor body 521. In this case, the rotor body 521 may include a bent part through hole 525 that allows the coupling body bent part 542 to pass therethrough.

The output shaft 65 may be inserted into the fixing panel through hole 153 so as to be connected to the drum 2, and the rear cover 23 may include a shaft bracket 231 (see FIG. 4) to which the output shaft 65 is fixed. This serves to disperse stress applied to the center of the rear cover 23 during rotation of the output shaft 65.

In order to prevent sagging of the housing H and to minimize deformation of the fixing part mounting groove 152, the housing H may be fixed to the fixing panel 151 using a transmission part bracket 61 and a housing coupling part 612.

As illustrated in FIG. 4, the transmission part bracket 61 may include a bracket through hole 611 configured to allow the output shaft 65 to pass therethrough, and the housing coupling part 612 may be implemented as a bolt that connects the housing H to the transmission part bracket 61. The transmission part bracket 61 may be made of the same material as the fixing panel 151 or may be made of a material having strength higher than the strength of the fixing panel 151.

While FIG. 4 illustrates the transmission part bracket 61 fixed to the surface of the fixing panel 151 facing the rear cover 23, the transmission part bracket 61 may be fixed to the surface facing the cover panel 19 in the space defined by the fixing panel 151.

Figure 8:
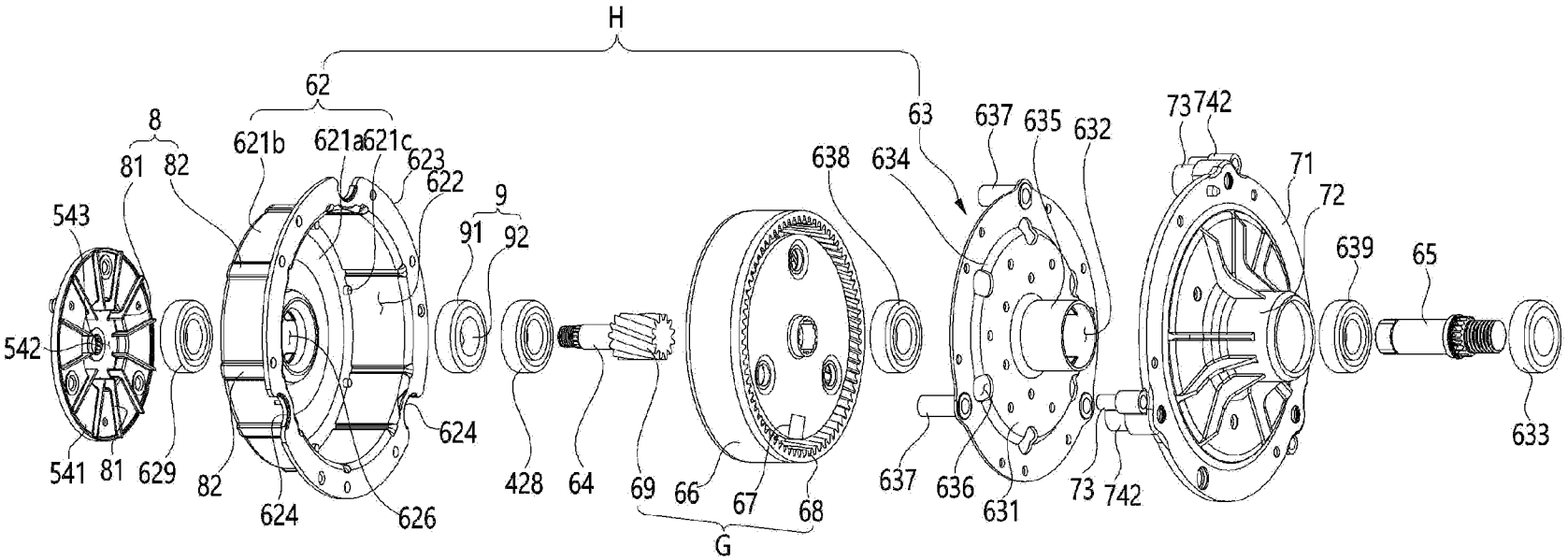

As illustrated in FIG. 8, the housing H may include a housing body 62, which is formed in a hollow cylindrical shape and has an opening formed in the surface thereof that faces the fixing panel 151, and a housing cover 63, which is fixed to the housing body 62 and configured to close the opening.

The housing body 62 may include an accommodation space 622 in which the gear unit G is mounted. The accommodation space 622 may be configured to communicate with the outside through the opening. The accommodation space 622 may be defined by a housing base 621*a* to which the input shaft 64 is fixed and a housing circumferential surface 621*b* extending from the edge of the housing base 621*a* toward the housing cover 63.

Figure 9:
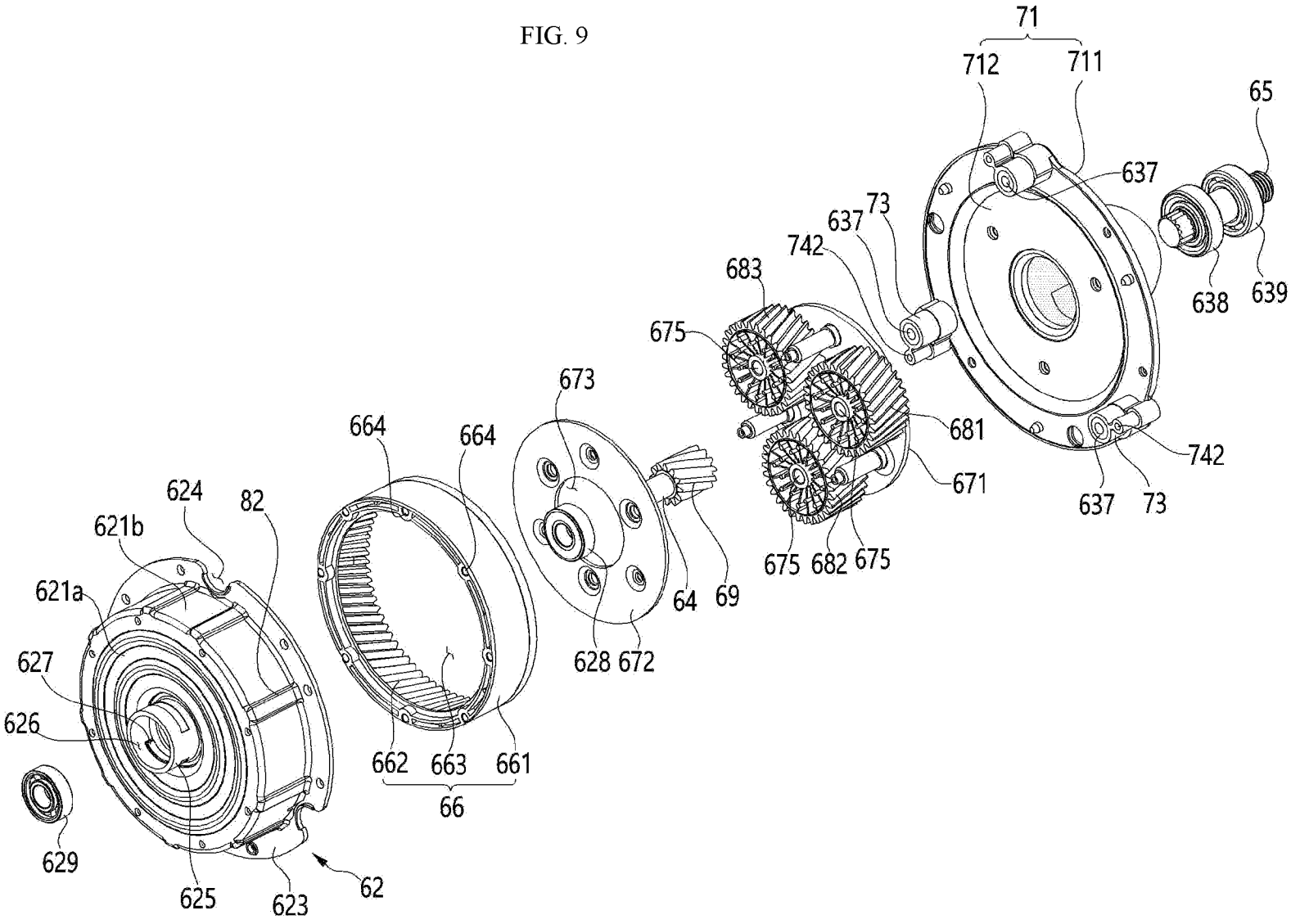

As illustrated in FIG. 9, the housing body 62 may include an input shaft support part 625 that extends from the housing base 621*a* toward the rotor 52. The input shaft support part 625 may be implemented as a pipe that surrounds an input shaft through hole 626 configured to pass through the housing body 62. That is, the input shaft through hole 626 is configured to pass through the input shaft support part 625 so as to be connected to the accommodation space 622.

The input shaft 64 inserted into the input shaft through hole 626 is rotatably fixed to the input shaft support part 625 using input shaft bearings 628 and 629. The input shaft bearings may include a first input shaft bearing 628 and a second input shaft bearing 629 which is fixed inside the input shaft through hole 626 so as to be located between the first input shaft bearing 628 and the rotor 52.

A free end of the input shaft support part 625 may be inserted into the coupling body bent part 542 provided at the shaft coupling part 54. The length of the input shaft support part 625 needs to be increased in order to couple the two input shaft bearings 628 and 629. However, when the free end of the input shaft support part 625 is inserted into the coupling body bent part 542, it is possible to minimize a space that is required for installation of the motor 5 and the power transmission part 6 (minimize the volume of the laundry treating apparatus).

The housing cover 63 may be formed in any of various shapes capable of opening or closing the opening provided at the housing body 62. FIG. 8 exemplarily illustrates the housing cover 63 including a disc-shaped cover body 631. The housing cover 63 may be fixed to the housing body 62 using a cover fixing plate 623 provided at the housing circumferential surface 621*b*.

The housing cover 63 may include an output shaft support part 635 extending from the cover body 631 toward the fixing panel 151, an output shaft through hole 632 configured to pass through the output shaft support part 635 and configured to allow the output shaft 65 to be inserted thereinto, and output shaft bearings 638 and 639 disposed at the output shaft support part 635 and configured to rotatably fix the output shaft 65 to the output shaft through hole 632.

The housing cover 63 includes a mounting part 637, which is provided at the cover body 631 and to which the stator 51 is fixed. The mounting part 637 may be formed in any of various shapes that allow the stator coupling part (the bolt or the like) to be coupled thereto. In the drawing, the mounting part 637 is formed in a hollow cylindrical shape.

The mounting part 637 may be provided in a plural number along the circumferential surface of the cover body 631. The stator bracket 515 may be provided in the same number as the number of mounting parts 637.

When the mounting part 637 is formed in the shape of a cylinder that protrudes from the cover body 631 toward the rotor 52, it is desirable for the cover fixing plate 623 to include a fixing plate through hole 624 into which the mounting part 637 is inserted. This serves to minimize the outer diameter of the cover fixing plate 623 (thereby minimizing a space that is required for installation of the housing).

In order to increase the strength of the housing cover 63, the cover body 631 may include a bent part 634 which is formed such that a region including the output shaft through hole 632 protrudes toward the fixing panel 151.

The output shaft bearings may include a first output shaft bearing 638 and a second output shaft bearing 639, which are fixed to the output shaft support part 635 and are disposed inside the output shaft through hole 631. In order to prevent external air from being supplied to the output shaft bearings 638 and 639, the housing cover 63 may further include a sealer 633 which is fixed to the output shaft support part 635 to close the output shaft through hole 632.

The housing H is fixed to the fixing panel 151 via the housing coupling part 612. The stator 51 is fixed to the housing H by fixing the stator coupling part inserted into the coupling part through hole 516 to the mounting part 637. The rotor 52 is fixed to the housing H using the input shaft 64. That is, since the stator 51 and the rotor 52 are fixed to the housing H (since the stator and the rotor vibrate together with the housing), deterioration in coaxiality between the input shaft 64 and the output shaft 65 may be minimized.

The gear unit G may include a ring gear 66 fixed to the housing circumferential surface 621*b* and disposed in the accommodation space 622, a driving gear 69 fixed to the input shaft 64 and disposed inside the accommodation space 622, a cage 67, which is disposed inside the accommodation space 622 and to which the other end of the output shaft 65 is fixed, and a driven gear 68 rotatably fixed to the cage 67 and configured to connect the driving gear 69 to the ring gear 66.

As illustrated in FIG. 9, the ring gear 66 may include a gear body 661 fixed to the housing circumferential surface 621*b* and gear teeth 662 disposed along the inner circumferential surface of the gear body.

The cage 67 may include a first base 671 which is disposed inside a gear body through hole 663 (a through hole formed by the gear teeth) configured to pass through the gear body and to which one end of the output shaft 65 is fixed, a second base 672 which is disposed inside the gear body through hole 663 and has a base through hole 673 formed at the center thereof, and a connection shaft 675 which connects the first base to the second base and configured to form a rotation shaft of the driven gear 68. Since the output shaft 65 is fixed to the first base 671, rotation of the output shaft depends on whether the cage 67 rotates.

The driven gear 68 may include a plurality of gears. In the drawing, the driven gear includes a first driven gear 681, a second driven gear 682, and a third driven gear 683. The input shaft 64 is inserted into the base through hole 673 to form coaxiality with the output shaft 65. The gear teeth of the driving gear 69 are disposed in a space formed between the driven gears so as to be engaged with the gear teeth of the driven gears 681, 682, and 683.

Figure 10:
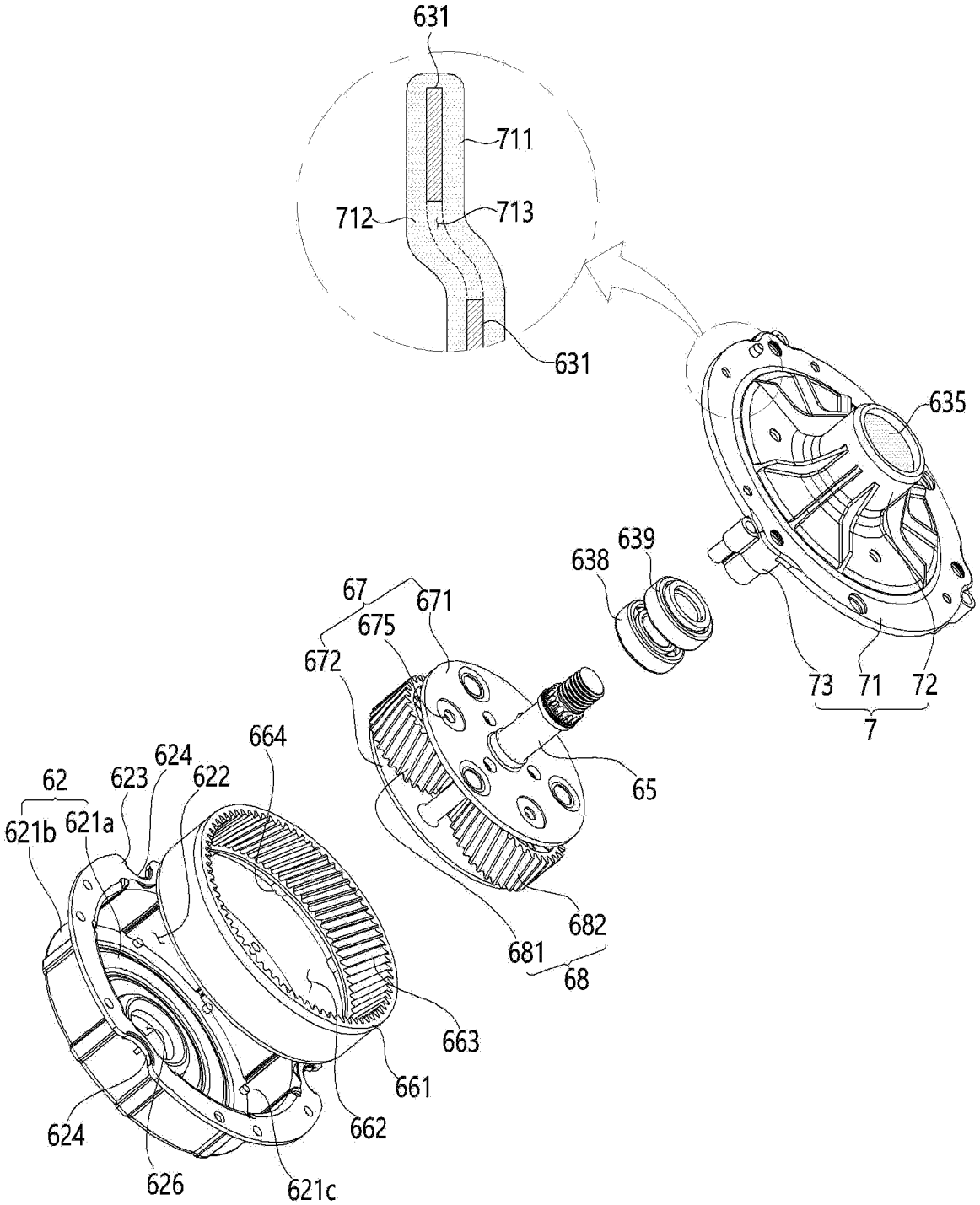

As illustrated in FIG. 10, in order to facilitate coupling or assembly between the ring gear 66 and the housing body 62, the gear body 661 may include a coupling protrusion accommodation groove 664, and the housing base 621*a* may include a ring gear coupling protrusion 621*c* inserted into the coupling protrusion accommodation groove 664.

In order to increase the durability of the gear unit G, the housing H may further include a heat insulation part 7. The heat insulation part 7 is configured to minimize transfer of external heat to the accommodation space 622 in the housing and is desirably made of a material having thermal conductivity lower than the thermal conductivity of the housing H. That is, when the housing body 62 and the housing cover 63 are made of metallic materials, it is desirable for the heat insulation part 7 to be made of a non-metallic material such as plastic.

When the housing H is fixed to the fixing panel 151 and is disposed in the external space of the cabinet, it is desirable for the heat insulation part 7 to be made of a material having thermal conductivity lower than the thermal conductivity of the fixing panel 151.

The heat insulation part 7 may be provided to surround the entire area of the housing H or may be provided only at a region facing the fixing panel 151 in the housing H. FIG. 10 exemplarily illustrates the heat insulation part 7 disposed only at the housing cover 63 (the region facing the fixing panel).

Figure 11:
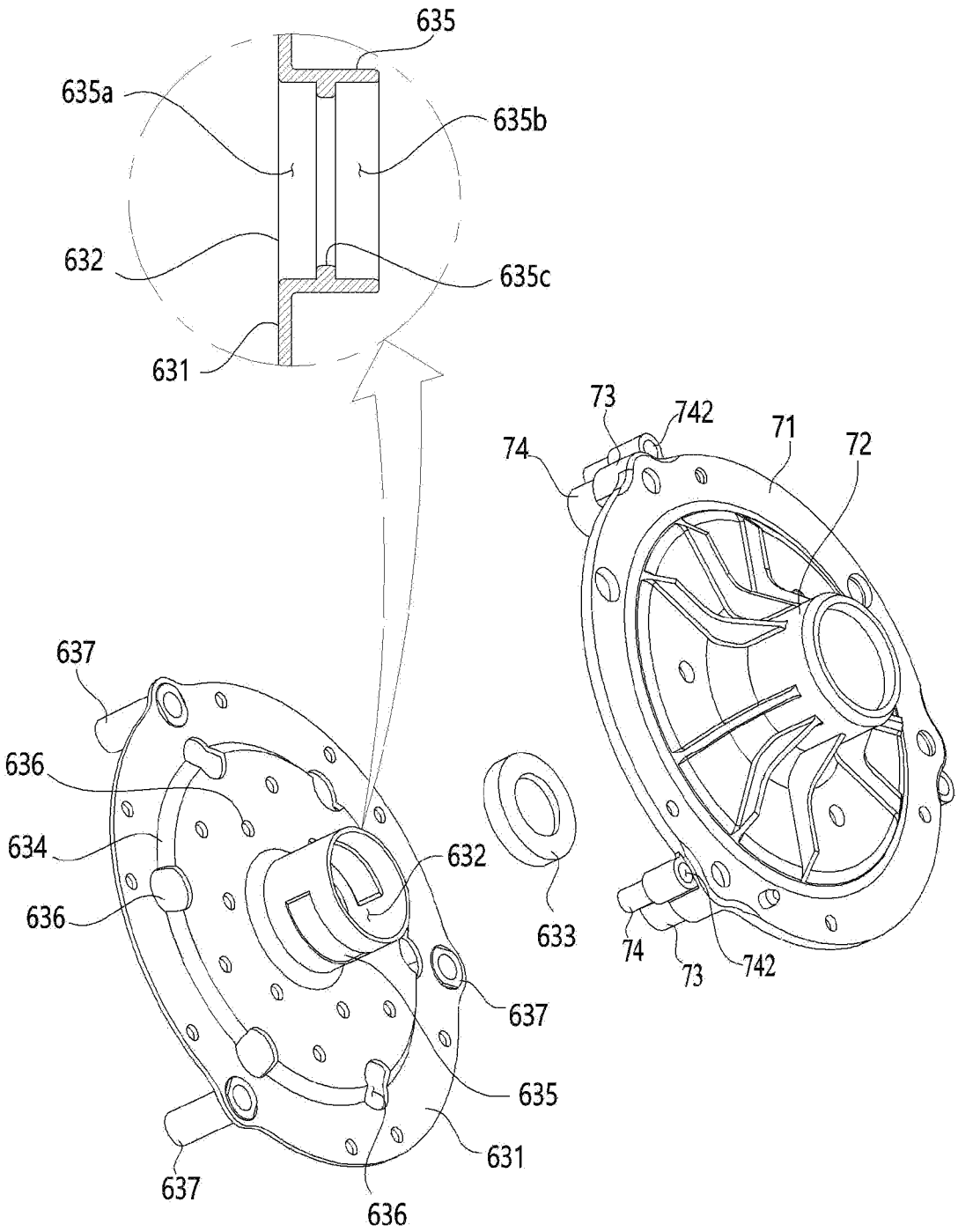
FIG. 11 illustrates an example of an insulation part.

As illustrated in FIG. 11, the heat insulation part 7 may be formed integrally with the housing cover 631. For example, the heat insulation part 7 and the housing cover 63 may be formed through insert injection molding in which a melted material (plastic or the like) is injected into a mold in which the housing cover 63 is accommodated.

The heat insulation part 7 may include a cover insulation body 71 fixed to the cover body 631 and a support part insulation body 72 configured to surround the circumferential surface of the output shaft support part 635. As illustrated in FIG. 10, the cover insulation body 71 may include at least one of a first insulation body 711 formed at the surface of the cover body 631 that faces the fixing panel 151 in a space defined by the cover body 631 or a second insulation body 712 formed at the surface of the cover body 631 that faces the housing body 62 in the space defined by the cover body 631.

When the cover insulation body 71 includes both the first insulation body 711 and the second insulation body 712, it is desirable for the cover insulation body 71 to further include a connection body 713 configured to pass through the cover body 631 so as to connect the first insulation body 711 to the second insulation body 712. In this case, the cover body 631 should be provided with a cover through hole 636 (see FIG. 11) in which the connection body 713 is located.

As illustrated in FIG. 11, the heat insulation part 7 may further include a mounting part insulation body 73 that surrounds the mounting part 637. This serves to minimize transfer of heat from the motor 5 to the cover body 631 through the mounting part 637. The mounting part insulation body 73 is desirably disposed to surround the entire area of the circumferential surface of the mounting part 637.

In order to facilitate coupling between the stator 51 and the mounting part 637, the laundry treating apparatus may further include a stator position setting part 74. The stator position setting part 74 may include a bracket protrusion 741 (see FIG. 5) disposed at the stator bracket 515 and a protrusion accommodation groove 742 (see FIG. 9) which is disposed at the second insulation body 712 and configured to allow the bracket protrusion 741 to be inserted thereinto.

Unlike the above-mentioned example, the heat insulation part may be fixed to the fixing panel 151 so as to be disposed between the housing cover 63 and the fixing panel 151 or may be fixed to the fixing panel 151 so as to be disposed between the fixing panel 151 and the rear cover 23. In this case, the heat insulation part may be configured to surround the fixing panel through hole 153 and may be implemented as a plate having a diameter larger than the diameter of the cover body.

In the power transmission part 6 having the above-described structure, the gear unit G is disposed inside the accommodation space 622 formed by the housing body 62. That is, the ring gear 66, the driving gear 69, and the driven gear 68 are provided so as to be prevented from escaping the accommodation space 622. The accommodation space 622 is formed only in the housing body 62 to dispose the gear unit G as far as possible from the fixing panel 151 (a heat source radiating heat inside the cabinet to the outside of the cabinet). Therethrough, the laundry treating apparatus 100 is capable of minimizing deterioration in the durability of the gear unit G.

Meanwhile, in the power transmission part 6 having the above-described structure, when the driving gear 69 and the driven gear 68 rotate, repulsive force acting between the gears is transmitted to the input shaft 64 and the output shaft 65. That is, when the driving gear and the driven gear rotate, external force acting in a direction away from the housing H or in a direction toward the inside of the housing H is input to the input shaft 64 and the output shaft 65. The above-described operation is noticeably observed when the driving gear, the driven gear, and the ring gear are implemented as helical gears.

Figure 12:
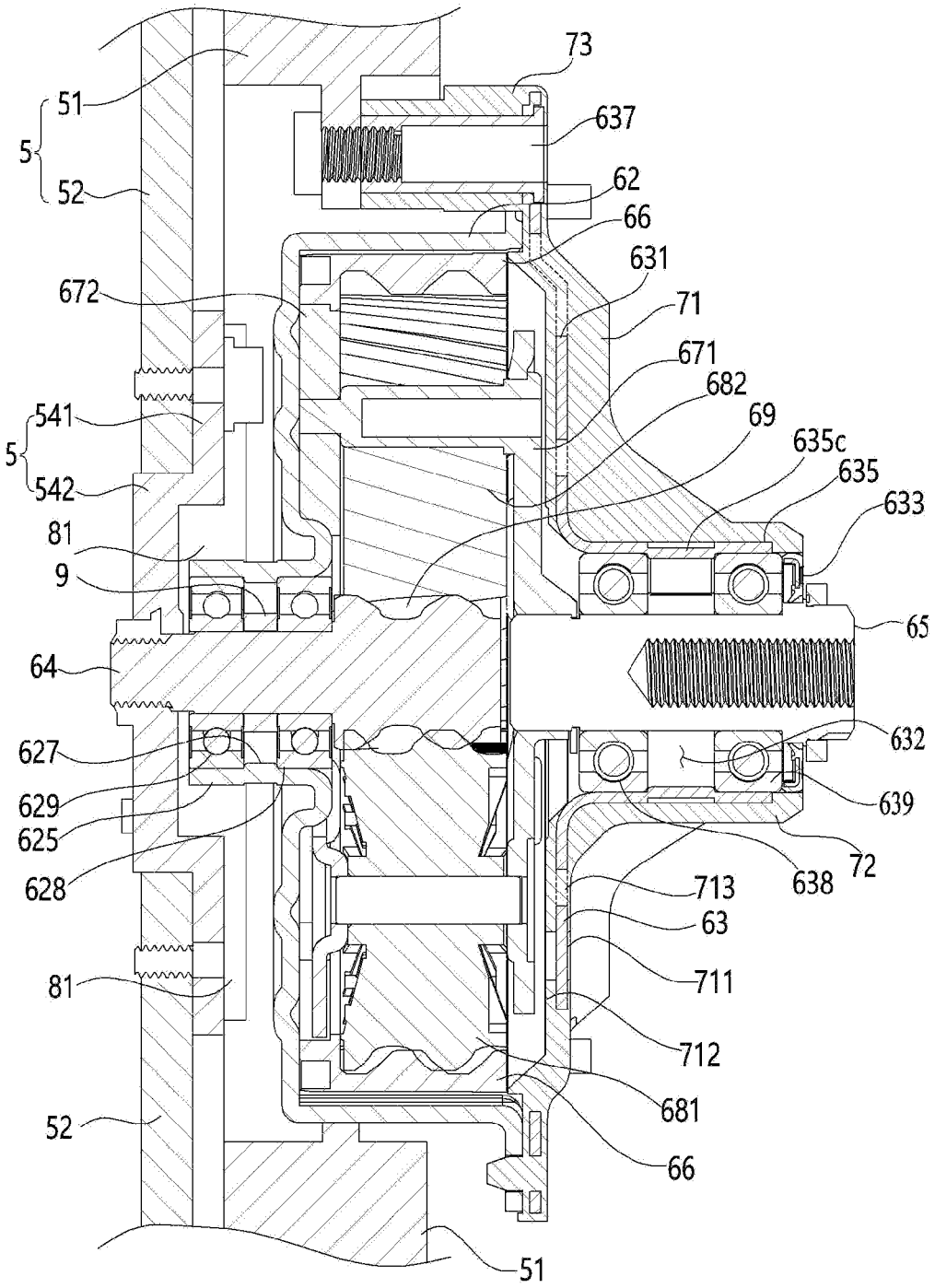
FIGS. 12 and 13 illustrate a cross section of the power transmission part.

As illustrated in FIG. 12, the laundry treating apparatus 100 may include a damper 9 in order to minimize the risk of separation of the input shaft 64 from the input shaft bearings 628 and 629 or the input shaft support part 625 due to external force acting on the input shaft 64.

The damper 9 is disposed at the input shaft through hole 626 so as to be located between the first input shaft bearing 628 and the second input shaft bearing 629 and is configured to reduce transmission of vibration of the first input shaft bearing 628 to the second input shaft bearing 629.

The damper 9 may be implemented as an elastic body (rubber or the like) that is fixed to the circumferential surface of the input shaft 64 and is disposed between the first input shaft bearing 628 and the second input shaft bearing 629. As illustrated in FIG. 8, the damper 9 may include a damping body 91 having a diameter larger than the diameter of the input shaft 64 and smaller than the diameter of the input shaft through hole 626 (a damping body having a diameter smaller than the outer diameter of the input shaft bearing) and a damping body through hole 92 configured to pass through the damping body 91 and allow the input shaft 64 to be inserted thereinto.

As illustrated in FIG. 12, in order to minimize vibration of the housing H, it is desirable for one surface of the damping body 91 to be in contact with the first input shaft bearing 628 and the other surface thereof to be in contact with the second input shaft bearing 629.

Furthermore, the input shaft support part 625 may further include a stopper 627 (a first stopper) that protrudes toward the center of the input shaft through hole 626 and is disposed between the first input shaft bearing 628 and the second input shaft bearing 629. The first stopper 627 serves as a means for restricting the range within which the first input shaft bearing 628 moves toward the second input shaft bearing 629 or a means for restricting the range within which the second input shaft bearing 629 moves toward the first input shaft bearing 628.

Since the damping body 91 is coupled to the circumferential surface of the input shaft 64 (since the damping body is provided so as to rotate together with the input shaft), it desirable to set the radius of the damping body 91 (the outer radius of the damper) to be shorter than the distance from the center of the input shaft through hole 626 to the first stopper 627.

In order to minimize the problem of separation of the output shaft bearings 638 and 639 from the housing H due to external force acting on the output shaft 65, the output shaft support part 635 may include a stopper 635*c* (a second stopper) configured to restrict the movement range of the first output shaft bearing 638 and the movement range of the second output shaft bearing 639. As illustrated in FIG. 11, the output shaft support part 635 may include a first mounting part 635*a* in which the first output shaft bearing 638 is disposed and a second mounting part 635*b* in which the second output shaft bearing 639 is disposed. The second stopper 635*c* may be formed as a protrusion disposed between the first mounting part 635*a* and the second mounting part 635*b*.

In order to minimize transfer of heat to the inside of the housing H and to dissipate heat from the housing H to the outside, the laundry treating apparatus may further include a heat dissipation part 8. As illustrated in FIG. 8, the heat dissipation part 8 may include at least one of a first heat dissipation part 81, which is disposed at the coupling body 541 and configured to discharge air between the housing body 62 and the rotor 52 to the outside of the rotor 52, or a second heat dissipation part 82, which is disposed at the circumferential surface 621*b* of the housing body and configured to dissipate heat in the accommodation space 622 to the outside of the accommodation space 622.

The first heat dissipation part 81 may be formed as a blade that protrudes from the coupling body 541 toward the housing base 621*a*. The coupling body 541 and the first heat dissipation part 81 will rotate while the rotor 52 rotates, so air between the rotor 52 and the housing body 62 is discharged to the outside of the rotor 52 through the rotor through hole 531, thereby dropping the temperature of the housing H.

FIG. 8 exemplarily illustrates the first heat dissipation part 81 having a plurality of blades which is disposed radially about the shaft coupling hole 543. Only a single blade may be provided at the coupling body 541.

Meanwhile, when the coupling body 541 includes the coupling body bent part 542, it is desirable for the first heat dissipation part 81 to have a blade extending from the coupling body bent part 542 to the edge of the coupling body 541. This enables the height of the blade (the length of the blade in a direction from the coupling body toward the housing body) to be increased, thereby increasing the amount of air that is discharged.

The second heat dissipation part 82 may include at least one of a housing protruding part (a cooling fin or the like) that protrudes from the housing circumferential surface 621*b* or a housing bent part (a bent groove or the like) that is bent from the housing circumferential surface 621*b* toward the accommodation space 622. The second heat dissipation part 82 serves to increase the surface area of the housing circumferential surface 621*b*, thereby facilitating heat exchange between the housing body 62 and external air.

Hereinafter, the operation process of the power transmission part 6 described above will be described with reference to FIG. 13.

Figure 13:
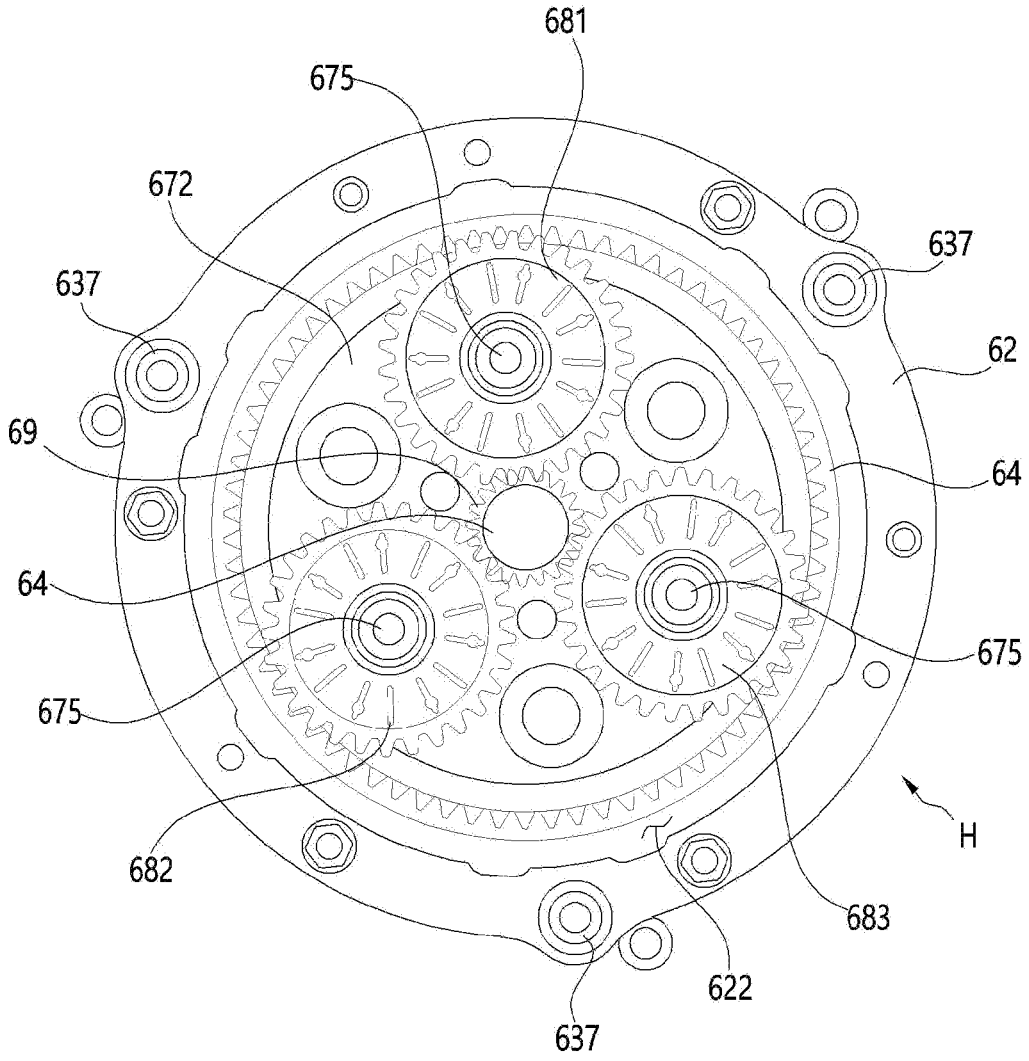

FIG. 13 illustrates the inside of the housing body 62. When the rotor 52 rotates, the input shaft 64 rotates. When the driving gear 69 rotates by the input shaft 64, the driven gears 681, 682, and 683 which are engaged with the driving gear 69 also rotate. Since the driven gears 681, 682, and 683 are engaged with the ring gear 66 fixed to the housing body 62, when the driven gear 68 rotates, the cage 67 and the output shaft 65 rotate, and the drum 2 fixed to the output shaft 65 also rotates.

A portion of heat supplied to the drum 2 by the drying part 3 is discharged to the outside of the drum 2 (the inside of the cabinet), and heat in the cabinet will be discharged to the outside of the cabinet. If the heat discharged from the cabinet 1 is transferred to the inside of the housing H of the power transmission part 6, the durability of the gear unit G may be deteriorated. However, the laundry treating apparatus 100 includes the heat insulation part 7 configured to minimize transfer of heat to the inside of the housing H, thereby reducing the risk of deterioration in the durability of the gear unit G.

In addition, since the laundry treating apparatus 100 includes the first heat dissipation part 81, which is provided at the coupling body 541 coupling the input shaft 64 to the rotor 52, the second heat dissipation part 82, which is disposed at the housing circumferential surface 621*b*, and the motor heat dissipation part 53, which is provided at the rotor, it is possible to minimize the occurrence of the state in which the stator 51 is overheated during rotation of the rotor 52 (during rotation of the drum) and the state in which the accommodation space 622 is overheated.

Figure 14:
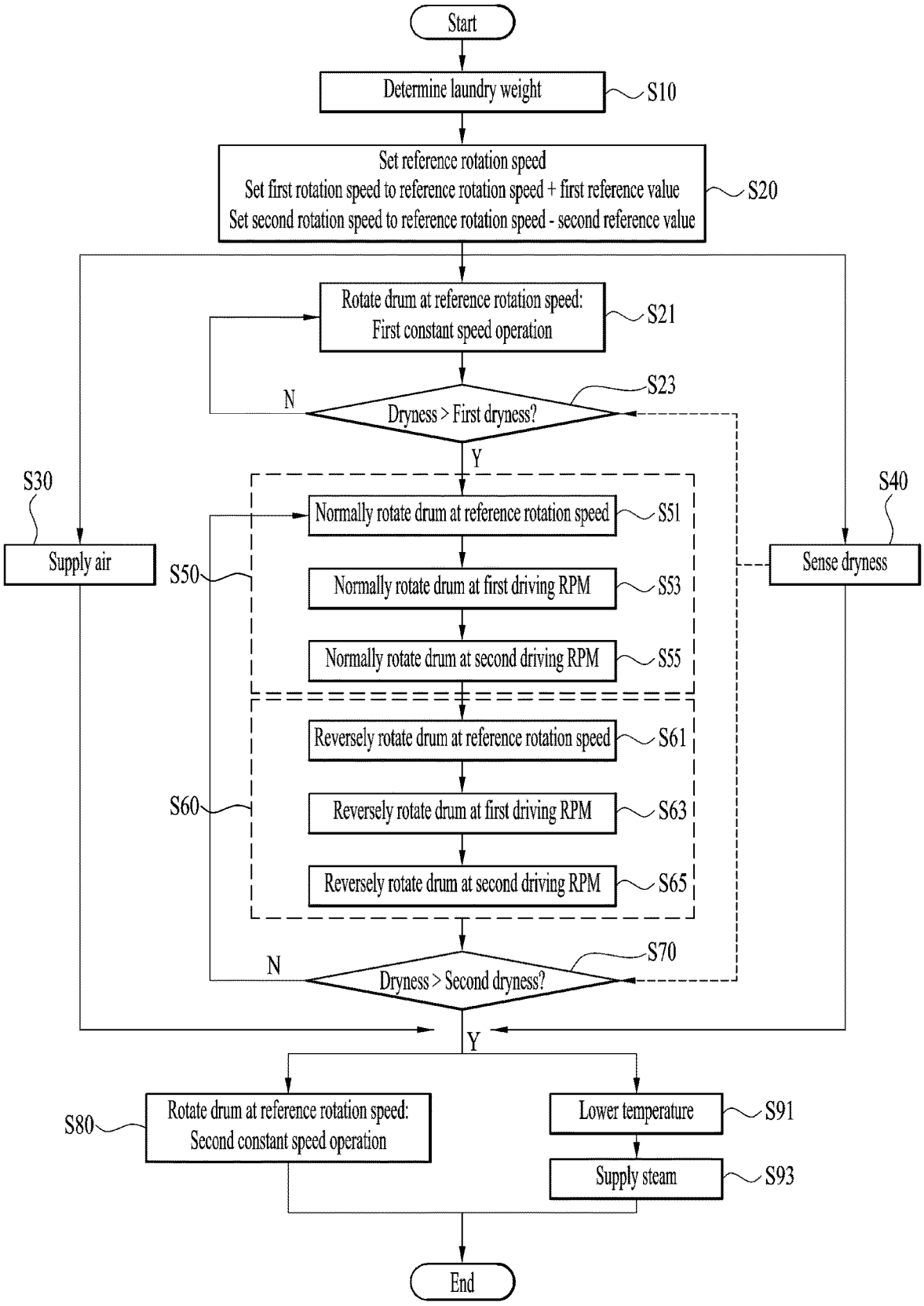
FIG. 14 illustrates an example of a control method of the laundry treatment apparatus.

FIG. 14 illustrates an example of a control method of a laundry treatment apparatus.

The control method includes a laundry weight determination operation (S10) of determining the amount of clothes stored in the drum 2, a setting operation (S20) of determining the rotation speed of the drum (a reference rotation speed, a first rotation speed, a second rotation speed, etc.) based on the weight of the clothes, and an air supply operation (S30) of supplying heated air to the drum 2 by the drying part 3.

The laundry weight determination operation (S10) is an operation of determining the amount of clothes introduced into the drum 2. The laundry weight determination operation (S10) may be performed to determine the amount of clothes stored in the drum 2 through the magnitude of current supplied to the stator 51 while the drum 2 rotates at a preset angle or may be performed to determine the amount of the clothes by measuring an angle at which the drum 2 rotates when a preset magnitude of current is supplied to the stator 51.

The setting operation (S20) is an operation of determining the reference rotation speed, the first rotation speed, and the second rotation speed. The reference rotation speed is a rotation speed causing a centrifugal force of 1G or less on clothes, which increases in proportion to the weight of the clothes measured in the laundry weight determination operation (S10). A rotation speed that causes a centrifugal force of 1G or more on clothes refers to a rotation speed at which the clothes rotate in close contact with the circumferential surface of the drum body 21. On the other hand, the rotation speed that causes a centrifugal force of 1G or less on clothes refers to a rotation speed at which the clothes repeat rising and falling inside the drum body 21 when the drum rotates.

The first rotation speed is set to a rotation speed obtained by adding a preset first reference value to the reference rotation speed, and the second rotation speed is set to a rotation speed obtained by subtracting a preset second reference value from the reference rotation speed. The first reference value and the second reference value may be set to different values or may be set to the same value.

The air supply operation (S30) is an operation of supplying heated air to the drum 2 by operating the heat exchange part 34. That is, the air supply operation (S30) operates the compressor 345, the pressure regulator 347, and the fan 349 to sequentially dehumidify and heat air discharged from the drum and then resupplies the heated air to the drum 2.

When the air supply operation (S30) is performed, the control method proceeds to a first motion execution operation (S50). The first motion execution operation (S50) may include rotating the drum 2 in a first direction set to either a clockwise direction or a counterclockwise direction at the reference rotation speed (S51), rotating the drum 2 in the first direction at the first rotation speed (S53), and rotating the drum 2 in the first direction at the second rotation speed (S53).

The first motion execution operation (S50) may be started after the air supply operation (S30) or may be started together with the air supply operation (S30).

In the first motion execution operation (S50), the rotation speed of the drum 2 changes to the reference rotation speed, the first rotation speed, and then the second rotation speed. If the rotation speed of the drum 2 sequentially changes as described above, clothes inside the drum 2 will move irregularly. The irregular motion of the clothes will allow air to be supplied evenly to the clothes, which has the effect of shortening a drying time and minimizing imbalanced drying. Imbalanced drying means that some of the clothes are in an under-dried state while the others are in an over-dried state. According to experiments, the above-described effect is effective when the first reference value and the second reference value are set to a value less than 10% of the reference rotation speed.

Meanwhile, the control method may perform a first constant speed operation (S21) after completion of the setting operation (S20) and before the start of the first motion execution operation (S50). The first motion execution operation (S50) is effective when clothes are not tangled inside the drum, and the first constant speed operation (S21) is a process for evenly spreading the clothes inside the drum.

The first constant speed operation (S21) is an operation of rotating the drum at the reference rotation speed. In the first constant speed operation (S21), the drum 2 may rotate only in one of clockwise and counterclockwise directions or may rotate alternately in the clockwise direction and the counterclockwise direction.

The first constant speed operation (S21) may be performed from the time when the air supply operation (S30) is started until the dryness of clothes put into the drum 2 reaches a preset first dryness, and the first motion execution operation (S50) may be started when the dryness of the clothes reaches the first dryness.

The dryness of the clothes may be measured through a dryness sensing operation (S40) performed after the air supply operation (S30) is started. The dryness sensing operation (S40) may be performed to measure the dryness of the clothes through sensing parts 121*a* and 121*b* (see FIG. 2) provided on the support panel 121 or may be performed to measure the dryness of the clothes through a temperature sensor 314 (see FIG. 2) disposed on the exhaust passage 31.

The sensing parts may be implemented as a first electrode 121*a* connected to a positive terminal of an electrode and a second electrode 121*b* connected to a negative terminal of the electrode. The first electrode 121*a* and the second electrode 121*b* need to be fixed to the support panel 121 and maintained spaced apart from each other. The first electrode 121*a* and the second electrode 121*b* may be fixed to a position below a horizontal line passing through the center of the entrance 111 in a space defined by the support panel 121. In this case, the two electrodes 121*a* and 121*b* will be easily contact clothes when the clothes are located below the horizontal line passing through the rotation center of the drum 2 (when the clothes are located at the lowest point of the drum).

As the dryness of clothes increases, the amount of water (moisture content) contained in the clothes will decrease. Accordingly, as the dryness increases, the magnitude of current detected by the sensing parts will decrease. That is, a control part (not illustrated) may estimate the dryness of the clothes by monitoring the magnitude of current transmitted by the sensing parts.

On the other hand, if the dryness of the clothes is low, the temperature of air discharged from the drum 2 will be low. Accordingly, as the dryness of the clothes increases, the temperature of air discharged from the drum will increase. That is, the temperature sensor 314 may estimate the dryness of the clothes by periodically sensing the temperature of air discharged from the drum.

The first dryness may be set to a dryness of 50% to 60% (dryness with a moisture content of 50% to 40%).

If the control method is configured to perform only the first motion execution operation (S50), since there is a risk of clothes becoming tangled inside the drum 2, the control method may be configured to perform a second motion execution operation (S60) after completion of the first motion execution operation (S50).

The second motion execution operation (S60) is an operation of rotating the drum in a direction opposite to the direction (first direction) set in the first motion execution operation. In the second motion execution operation (S60), the drum is rotated according to the reference rotation speed, the first rotation speed, and the second rotation speed.

That is, the second motion execution operation (S60) includes rotating the drum 2 in the second direction at the reference rotation speed, rotating the drum 2 in the second direction at the first rotation speed, and rotating the drum 2 in the second direction at the second rotation speed.

The first motion execution operation (S50) and the second motion execution operation (S60) may be performed alternately. The first motion execution operation (S50) and the second motion execution operation (60) may be ended when the dryness of the clothes reaches a second dryness (a target dryness, i.e., a dryness at which the air supply operation is ended). The second dryness may be set to a dryness of 95% to 97% (a dryness with a moisture content of 5% to 3%).

When the dryness of the clothes reaches the second dryness (S70), the control method may be configured to perform a second constant speed operation (S80). The second constant speed operation (S80) is an operation of rotating the drum at the reference rotation speed. In the second constant speed operation (S80), the drum 2 may be controlled to be rotated only in either a clockwise direction or a counterclockwise direction or may be controlled to be rotated alternately in the clockwise direction and the counterclockwise direction.

While performing the second constant speed operation (S80), the control method may be configured to perform at least one of a cooling operation (S91) or a steam supply operation (S93). FIG. 14 exemplarily illustrates the cooling operation (S91) and the steam supply operation (S93) being performed sequentially.

The cooling operation (S91) is an operation of lowering a temperature inside the drum 2 (an operation of supplying unheated air to the drum) by operating only the fan 349 of the heat exchange part 34, and the steam supply operation (S93) is an operation of supplying steam to the drum by operating the steam supply part 25.

Figure 15:
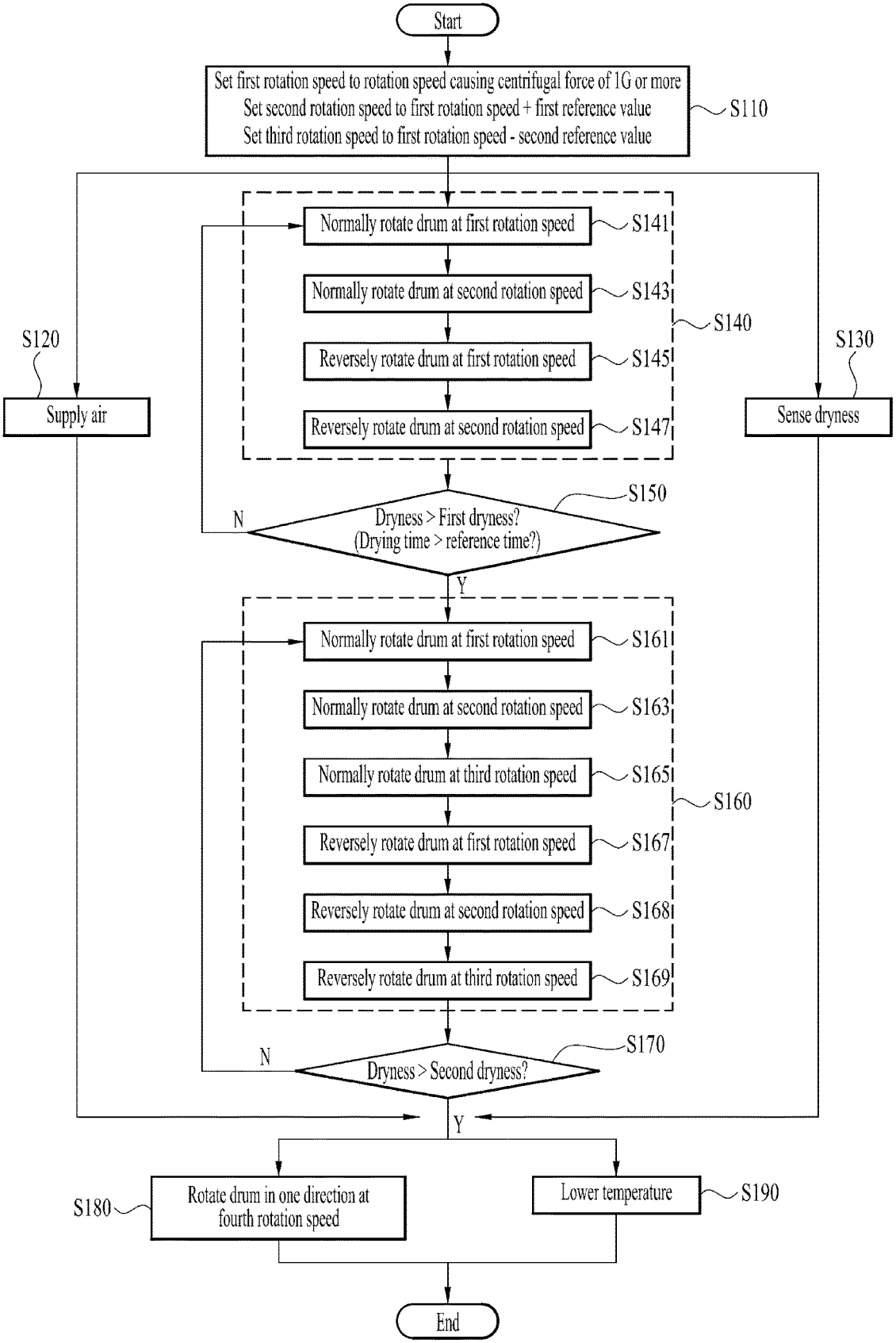
FIG. 15 illustrates another embodiment of a control method of the laundry treatment apparatus.

FIG. 15 illustrates another embodiment of a control method for a laundry treatment apparatus. The control method according to this embodiment may characteristically improve drying performance when drying bulky clothes.

The control method according to this embodiment includes a setting operation (S110) of determining the rotation speed of the drum (a reference rotation speed, a first rotation speed, a second rotation speed, etc.), an air supply operation (120) of supplying heated air to the drum 2 by the drying part 3, and a first motion execution operation S140 of rotating the drum 2 according to the rotation speed set in the setting operation.

The setting operation (S110) is an operation of determining a first rotation speed, a second rotation speed, and a third rotation speed. The first rotation speed is set to a rotation speed that causes a centrifugal force of 1G or more on clothes. The second rotation speed is set to a rotation speed obtained by adding a preset first reference value to the first rotation speed. The third rotation speed is set to a rotation speed obtained by subtracting a preset second reference value from the first rotation speed. The first reference value and the second reference value may be set to different values or may be set to the same value.

The rotation speed that causes a centrifugal force of 1G or more on clothes refers to a rotation speed at which the clothes rotate in close contact with the circumferential surface of the drum body 21. On the other hand, a rotation speed that causes a centrifugal force of 1G or less on clothes refers to a rotation speed at which clothes repeat rising and falling inside the drum body 21 when the drum rotates.

The air supply operation (S120) is an operation of supplying heated air to the drum 2 by operating the heat exchange part 34. That is, the air supply operation (S120) operates the compressor 345, the pressure regulator 347, and the fan 349 to sequentially dehumidify and heat air discharged from the drum and then resupplies the heated air to the drum 2.

The first motion execution operation (S140) may be started after the air supply operation (S120) or may be started together with the air supply operation (S120).

The first motion execution operation S140 may include rotating the drum 2 in a direction (a first direction) set to any one of a clockwise direction and a counterclockwise direction at the first rotation speed (S141), rotating the drum 2 in the first direction at the second rotation speed (S143), rotating the drum 2 in a direction (a second direction) set to the other one of the clockwise direction and the counterclockwise at the first rotation speed (S145), and rotating the drum 2 in the second direction at the second rotation speed (S147).

Since the first motion execution operation (S140) is configured to rotate the drum at two rotation speeds (the first rotation speed and the second rotation speed) that cause a centrifugal force of 1G or more on clothes, clothes inside the drum maintain close contact with the circumferential surface of the drum body 21.

Meanwhile, since the second rotation speed is set to be greater than the first rotation speed, when the first motion execution operation (S140) is performed, a passage from the rear cover 23 toward the drum entrance 221 may be formed. The passage from the rear cover 23 toward the drum entrance 221 makes it easy for air flowing into the air inflow port 233 of the rear cover to be transferred to the exhaust port 126 provided in the support panel 121 and facilitates heat exchange between clothes and air in this process.

Bulky clothes, such as a blanket, may prevent the air flowing into the air inflow port 233 from being transferred to the exhaust port 126, causing a problem of an increased drying time. The first motion execution operation (S140) may minimize the above-mentioned problem by rotating the drum at two rotation speeds that cause a centrifugal force of 1G or more.

In order to maximize the above-described effect, the control method may be configured to sequentially perform rotating the drum in the first direction at the first rotation speed (S141), rotating the drum in the first direction at the second rotation speed (S143), rotating the drum in the second direction at the first rotation speed (S143), and rotating the drum in the second direction at the second rotation speed (S145).

The first motion execution operation (S140) may be performed until the dryness of clothes reaches a preset first dryness or performed until an execution time of the air supply operation (S120) reaches a preset reference time (S150).

The dryness of clothes may be measured through a dryness sensing operation (S130) performed after the air supply operation (S120) is started. The dryness sensing operation (S130) may be performed to measure the dryness of clothes through the sensing parts 121*a* and 121*b* (see FIG. 2) provided on the support panel 121 or may be performed to measure the dryness of clothes through the temperature sensor 314 (see FIG. 2) disposed on the exhaust passage 31.

The sensing parts may be implemented as the first electrode 121*a* connected to a positive electrode of an electrode and the second electrode 121*b* connected to a negative electrode of the electrode. The first electrode 121*a* and the second electrode 121*b* need to be fixed to the support panel 121 and maintained spaced apart from each other. The first electrode 121*a* and the second electrode 121*b* may be fixed to a position below a horizontal line passing through the center of the entrance 111 in a space defined by the support panel 121. In this case, the two electrodes 121*a* and 121*b* may be easily contact clothes when the clothes are located below the horizontal line passing through the rotation center of the drum 2 (when the clothes are located at the lowest point of the drum).

As the dryness of clothes increases, the amount of water (moisture content) contained in the clothes will decrease. Accordingly, as the dryness of clothes increases, the magnitude of current detected by the sensing parts will decrease. That is, a control part (not illustrated) may estimate the dryness of clothes by monitoring the magnitude of current transmitted by the sensing parts.

On the other hand, if the dryness of clothes is low, the temperature of air discharged from the drum 2 will be low. Accordingly, as the dryness of clothes increases, the temperature of air discharged from the drum will increase. That is, the temperature sensor 314 may estimate the dryness of clothes by periodically sensing the temperature of air discharged from the drum.

The first dryness in the control method of the present embodiment may be set to a dryness of 50% to 60% (dryness with a moisture content of 50% to 40%), and the referent time may be set to a time at which the dryness of clothes is 50% to 60% (time at which the moisture content of clothes is 50% to 40%).

If the control method is configured to perform only the first motion execution operation (S140), since there is a risk of air being supplied to the clothes unevenly, the control method may be configured to perform a second motion execution operation (S160) after completion of the first motion execution operation (S150).

The second motion execution operation (S160) of this embodiment may include rotating the drum 2 in the first direction at the first rotation speed (S161), rotating the drum 2 in the first direction at the second rotation speed (S163), rotating the drum 2 in the first direction at the third rotation speed (S165), rotating the drum 2 in the second direction at the first rotation speed (S167), rotating the drum 2 in the second direction at the second rotation speed (S168), and rotating the drum 2 in the second direction at the third rotation speed (S169). It is desirable to sequentially perform the above-described operations (S161, S163, S165, S167, S168, and S169).

According to experiments, the effect of the first motion execution operation and the second motion execution operation is effective when the first reference value and the second reference value are set to a value less than 10% of the first rotation speed.

The second motion execution operation (S160) may be terminated when the dryness of clothes reaches a second dryness (a target dryness, i.e., a dryness at which the air supply operation is ended) (S170). The second dryness in the control method of this embodiment may be set to a dryness of 95% to 97% (dryness with a moisture content of 5% to 3%).

When the dryness of clothes reaches the second dryness (S170), the control method may be configured to perform a constant speed motion execution operation (S180) of rotating the drum 2 at a fourth rotation speed. The fourth rotation speed is set to a rotation speed lower than the third rotation speed. In the second constant speed motion execution operation (S180), the drum 2 may be configured to be rotated only in one of a clockwise direction and a counterclockwise direction or may be configured to be rotated alternately in the clockwise direction and the counterclockwise direction.

While the constant speed motion execution operation (S180) is in progress, the control method may proceed to a cooling operation (S190) of supplying unheated air to the drum 2. The cooling operation (S190) is an operation of lowering a temperature inside the drum 2 by operating only the fan 349 of the heat exchange part 34.

The above-described laundry treatment apparatus may be modified and implemented in various forms, and the scope of the present disclosure is not limited to the above-described embodiments.

The invention claimed is:

1. A control method of a laundry treatment apparatus including: a drum configured to form a space in which clothes are stored and having an entrance formed on a front surface thereof; a fixing panel; an output shaft configured to pass through the fixing panel so as to be connected to the drum; an input shaft configured to be rotated by a motor and form coaxiality with the output shaft; a gear unit configured to connect the input shaft to the output shaft to rotate the output shaft at a rotation speed lower than a rotation speed of the input shaft; and a drying part configured to supply heated air or unheated air to the drum, the control method comprising:

a laundry weight determination operation of determining the amount of clothes stored in the drum;

a setting operation of setting a rotation speed that causes a centrifugal force of 1G or less according to the amount of clothes to a reference rotation speed;

an air supply operation of supplying heated air to the drum by the drying part; and a first motion execution operation of rotating the drum at a reference rotation speed, a first rotation speed set to be higher than the reference rotation speed, and a second rotation speed set to be lower than the reference rotation speed, wherein the first motion execution operation includes:

rotating the drum in a first direction set to any one of a clockwise direction and a counterclockwise direction at the reference rotation speed;

rotating the drum in the first direction at the first rotation speed; and rotating the drum in the first direction at the second rotation speed.

2. The control method of claim 1, wherein the first motion execution operation sequentially performs rotating the drum in the first direction at the reference rotation speed, rotating the drum in the first direction at the first rotation speed, and rotating the drum in the first direction at the second rotation speed.

3. The control method of claim 2, further comprising a second motion execution operation performed after completion of the first motion execution operation, wherein the second motion execution operation includes:

rotating the drum in a second direction set to the other one of the clockwise direction and the counterclockwise direction at the reference rotation speed;

rotating the drum in the second direction at the first rotation speed; and rotating the drum in the second direction at the second rotation speed.

4. The control method of claim 3, wherein the second motion execution operation sequentially executes rotating the drum in the second direction at the reference rotation speed, rotating the drum in the second direction at the first rotation speed, and rotating the drum in the second direction at the second rotation speed.

5. The control method of claim 1, further comprising a first constant speed operation of rotating the drum at the reference rotation speed, wherein the first constant speed operation is performed before the first motion execution operation is performed.

6. The control method of claim 5, wherein the first constant speed operation is configured to rotate the drum in only one of the clockwise direction and the counterclockwise direction.

7. The control method of claim 5, wherein the first constant speed operation is configured to alternately rotate the drum in the clockwise direction and the counterclockwise direction.

8. The control method of claim 5, wherein the first rotation speed is set to a value greater than the reference rotation speed by a preset first reference value, and wherein the second rotation speed is set to a value smaller than the reference rotation speed by a second reference value.

9. The control method of claim 8, wherein the first reference value is set to be equal to the second reference value.

10. The control method of claim 8, wherein the first reference value and the second reference value are set to values less than 10% of the reference rotation speed.

11. The control method of claim 5, wherein, when a dryness of the clothes stored in the drum reaches a preset target dryness, the first motion execution operation and the second motion execution operation are terminated, and a second constant speed motion of rotating the drum at the reference rotation speed is performed.

12. The control method of claim 11, further comprising at least one of: a cooling operation of supplying unheated air to the drum; or a steam supply operation of supplying steam to the drum, during execution of the second constant speed motion.

13. The control method of claim 11, wherein the first constant speed motion is performed until the dryness of the clothes reaches a first dryness set to be lower than the target dryness, and wherein the first motion execution operation is started when the dryness of the clothes reaches the first dryness.

14. The control method of claim 13, wherein the first dryness is set to a dryness with a moisture content of 40% to 50%, and the target dryness is set to a dryness with a moisture content of 3% to 5%.

* * * * *